US006658673B2

(12) United States Patent
Hand

(10) Patent No.: US 6,658,673 B2
(45) Date of Patent: Dec. 9, 2003

(54) TOILET VALVE ASSEMBLY

(76) Inventor: Douglas P. Hand, 17321 SW. Canyon Dr., Lake Oswego, OR (US) 97034

( * ) Notice: Subject to any disclaimer, the term of this patent is extended or adjusted under 35 U.S.C. 154(b) by 0 days.

(21) Appl. No.: 10/304,309

(22) Filed: Nov. 25, 2002

(65) Prior Publication Data

US 2003/0074727 A1 Apr. 24, 2003

Related U.S. Application Data

(63) Continuation-in-part of application No. PCT/US02/01824, filed on Jan. 18, 2002, which is a continuation of application No. 09/957,812, filed on Sep. 20, 2001, now abandoned, application No. 10/304,309, which is a continuation-in-part of application No. 09/765,690, filed on Jan. 19, 2001, now Pat. No. 6,484,327.

(51) Int. Cl.[7] ..... E03D 3/12
(52) U.S. Cl. ..... 4/326
(58) Field of Search ..... 4/326, 327

(56) References Cited

U.S. PATENT DOCUMENTS

| | | | | |
|---|---|---|---|---|
| 1,767,043 A | * | 6/1930 | Blaun et al. | 4/326 |
| 3,172,129 A | | 3/1965 | Fulton et al. | |
| 3,186,007 A | | 6/1965 | Falotico | |
| 3,267,491 A | | 8/1966 | Snyder et al. | |
| 3,795,016 A | | 3/1974 | Eastman | |
| 3,890,652 A | | 6/1975 | Fulton | |
| 3,916,455 A | | 11/1975 | Longdin | |
| 3,958,281 A | | 5/1976 | Remmel | |
| 4,042,982 A | | 8/1977 | Contreras | |
| 4,096,591 A | | 6/1978 | Awis | |
| 4,115,882 A | | 9/1978 | Paulus | |
| 4,172,299 A | | 10/1979 | Del Pozo | |
| 4,353,138 A | | 10/1982 | Bell | |
| 4,604,763 A | | 8/1986 | Sprang | |
| 5,005,225 A | | 4/1991 | Pasquin | |
| 5,754,986 A | | 5/1998 | Chien | |
| 5,813,059 A | | 9/1998 | Wang | |
| 5,881,399 A | | 3/1999 | Kartoleksono et al. | |
| 6,041,452 A | | 3/2000 | Hsiao et al. | |
| 6,178,567 B1 | | 1/2001 | Bliss | |

FOREIGN PATENT DOCUMENTS

| | | |
|---|---|---|
| DE | 2829194 A1 | 1/1980 |
| DE | 3319649 A1 | 10/1983 |
| DE | 3221747 A1 | 12/1983 |

* cited by examiner

*Primary Examiner*—Charles E. Phillips
(74) *Attorney, Agent, or Firm*—Kolisch Hartwell, P.C.

(57) ABSTRACT

A modular outflow valve assembly for a toilet tank is disclosed. The modular outflow valve assembly includes a lower outflow tube section configured to be mounted to a toilet tank to pass water out of the toilet tank, wherein the lower outflow tube section has a high-volume flush valve configured to flush a first, higher volume of water when opened; an upper outflow tube section having a low-volume flush valve configured to flush a second, lower volume of water out of the toilet tank when opened, wherein the lower outflow tube section is configured to receive attachment of the upper outflow tube section to form a dual flush-volume configuration; and an overflow tube section, wherein the lower outflow tube section is configured to receive attachment of the overflow tube section in place of the upper outflow tube section to form a single flush-volume configuration.

14 Claims, 16 Drawing Sheets

TOILET VALVE ASSEMBLY

CROSS-REFERENCE TO RELATED APPLICATIONS

This application is a continuation-in-part of PCT Application Serial No. PCT/US02/01824, filed on Jan. 18, 2002, and is a continuation of and claims priority from U.S. patent application Ser. No. 09/957,812, filed on Sep. 20, 2001 now abandoned, which is a continuation-in-part of U.S. patent application Ser. No. 09/765,690, filed on Jan. 19, 2001 is now U.S. Pat. No. 6,484,327, the disclosures of which are incorporated by reference herein.

TECHNICAL FIELD

The present invention relates to a dual flush-volume valve assembly for a toilet tank. More particularly, the invention provides a modular dual flush-volume valve assembly for a toilet tank that may be installed as either, or converted between, a single flush-volume system and a double flush-volume system.

BACKGROUND OF THE INVENTION

In the past, most toilets manufactured in the U.S. discharged approximately 3–5 gallons of water per flush. More recently, however, concerns with water conservation, combined with federal law requiring new toilets to have a maximum discharge volume of 1.6 gallons per flush, have led to the development of new water-conserving toilet systems and various devices for reducing the water consumption of older toilets.

One example of a device used to increase the efficiency of older toilets is a dual flush-volume toilet tank outflow valve assembly. Dual flush valve assemblies utilize separate flush valves that discharge different amounts of water for flushing solid and liquid waste. In one type of dual flush-volume valve assembly, a high-volume flush valve is positioned near the bottom of the toilet tank to pass a higher volume of water for flushing solid waste, and a low-volume flush valve is positioned higher in the toilet tank for passing a lower volume of water for flushing liquid waste. Thus, a user may select a high-volume flush when clogging presents a problem, and otherwise use a low-volume flush.

While known dual flush-volume valve assemblies do offer improved water conservation relative to older, high-volume toilet systems, they also have several shortcomings. For example, known dual flush-volume valve assemblies permit little, if any, adjustment of the relative volumes of the low-volume flush and the high-volume flush. This can pose a problem in retrofitting older toilet tanks, as the volume of water passed from the toilet tank during a low-volume flush may be dependent upon the shape of the toilet tank. As an example, when using a dual valve assembly of a selected height, more water may be discharged by the low-volume valve from a taller tank than from a shorter tank, as the level of water in the shorter tank may be closer to the low-volume valve than in the taller tank. This may cause problems with flushing, as an inadequate amount of water to flush waste from the toilet bowl may be discharged if the maximum water level in the toilet tank is too close to the low-volume valve.

Furthermore, the conversion of a single flush-volume valve system to known dual flush-volume valve systems may pose various difficulties. These difficulties may cause many consumers to avoid converting a single-volume flush system to a dual flush system, even given the long-term cost advantages of using less water per flush. Likewise, some toilet tanks may not be suited for fitting with dual flush-volume valve systems, while others may not be suited for fitting with single flush-volume valve systems. For these reasons, manufacturers may have to manufacture, and stores may need to stock, both single-volume valve systems and double-volume valve systems, which may increase manufacturing and distribution expenses.

SUMMARY

Some embodiments provide a modular outflow valve assembly for a toilet tank, including a lower outflow tube section configured to be mounted to a toilet tank to pass water out of the toilet tank, wherein the lower outflow tube section has a high-volume flush valve configured to flush a first, higher volume of water when opened; an upper outflow tube section having a low-volume flush valve configured to flush a second, lower volume of water out of the toilet tank when opened, wherein the lower outflow tube section is configured to receive attachment of the upper outflow tube section to form a dual flush-volume configuration; and an overflow tube section, wherein the lower outflow tube section is configured to receive attachment of the overflow tube section in place of the upper outflow tube section to form a single flush-volume configuration.

DETAILED DESCRIPTION OF THE DEPICTED EMBODIMENTS

Various embodiments of the present invention provide modular single or dual flush-volume toilet tank outflow valve assemblies that may be easily converted between single and dual flush-volume configurations. Furthermore, various embodiments of the dual flush-volume configurations offer improved adjustability and flush performance compared to known dual valve assemblies.

Figure 1:
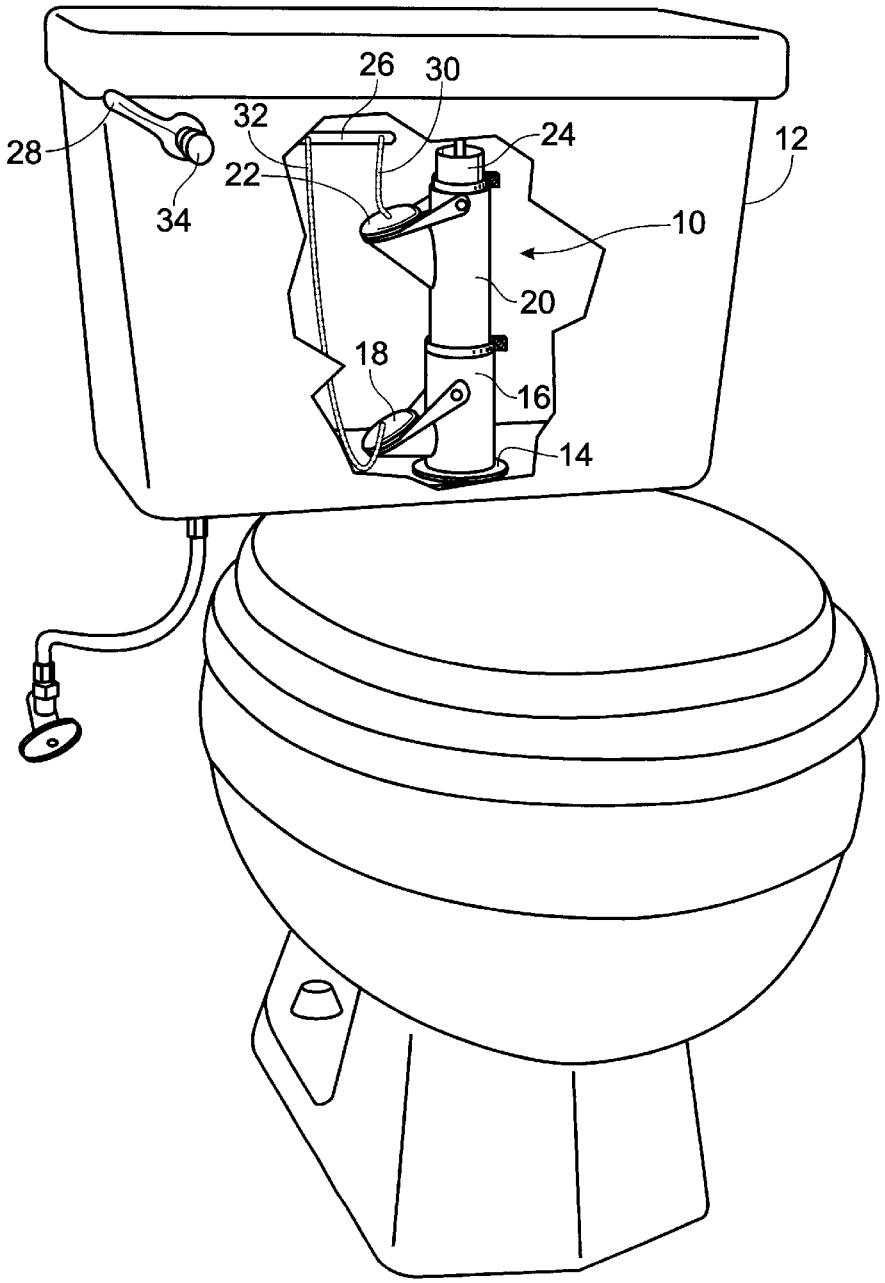
FIG. 1 is an isometric view of a dual-volume configuration of a modular outflow valve assembly according to a first embodiment of the present invention positioned in a toilet tank, assembled in a dual flush-volume configuration.

A first embodiment of a modular valve assembly according to the present invention is shown generally at 10 in FIG. 1, positioned in a toilet tank 12 and assembled in a dual flush-volume configuration. Modular valve assembly 10 includes a base 14 with which it may be mounted to the inside of toilet tank 12.

A lower outflow tube section 16 extends upwardly from base 14, and a high-volume flush valve 18 is positioned on the lower outflow tube section adjacent the bottom of the interior of toilet tank 12. High-volume flush valve 18 is configured to empty essentially all water from toilet tank 12 when opened to provide a higher volume flush for flushing solid wastes. An upper outflow tube section 20 is slidably coupled to lower outflow tube section 16, and a low-volume flush valve 22 is positioned on the upper outflow tube section. Low-volume flush valve 22 is configured to empty toilet tank 12 only partially, thus providing a water-saving, smaller volume flush. It will be appreciated that modular valve assembly 10 may be easily converted to a single-volume flush valve system by replacing upper outflow tube section 20 with an overflow tube section, as described in more detail below in reference to FIG. 22.

The slidable connection of lower outflow tube section 16 to upper outflow tube section 20 allows the height of low-volume flush valve 22 to be adjusted relative to the height of high-volume flush valve 18. This allows the volume of water discharged by low-volume flush valve 22 to be adjusted for toilet tanks of different sizes, permitting the volume of water discharged by the low-volume flush valve to be quickly and easily adjusted over a wide range of volumes. This wide range of adjustability allows valve system 10 to be used in essentially any new or existing gravity flush toilet system. Modular valve assembly 10 also includes an overflow tube section 24, which also may be adjustable in height to provide infinitesimal control of the low-volume flush. As described in more detail below and depicted in FIG. 21, overflow tube section 24 may be connected directly to lower outflow tube section 16 to form a single flush-volume valve system with an adjustable overflow tube height if desired.

FIG. 1 also shows an example of a suitable setup for the operation of valve system 10 in a toilet. High-volume flush valve 18 and low-volume flush valve 22 are both attached to a single flush wand 26, which is operated by a handle 28. Low-volume flush valve 22 is connected to flush wand 26 with a first, shorter length of chain 30, and high-volume flush valve 18 is connected to the flush wand with a second, longer length of chain 32. Second length of chain 32 is configured to have more slack than first length of chain 30. This allows low-volume flush valve 22 to be opened by pushing handle 28 only partially down when a low volume flush is desired, and both the low-volume flush valve and high-volume flush valve 18 to be opened by pushing handle 28 farther down when a higher volume flush is desired. In the depicted embodiment, handle 28 employs a special mechanism, described in more detail below, that prevents the handle from being pushed far enough to open high-volume flush valve 18 unless a handle release button 34 is held down.

Figure 3:
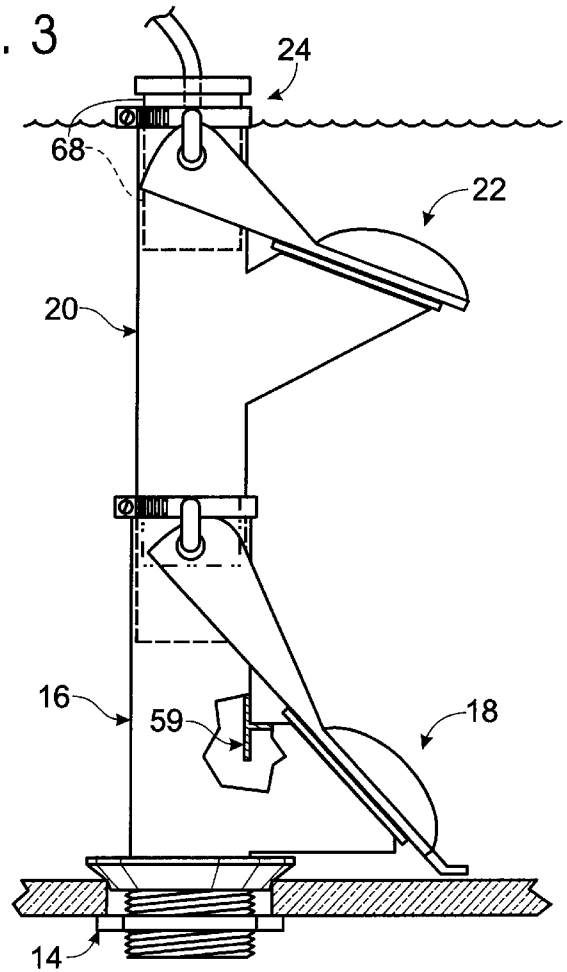
FIG. 3 is a side elevational view of the embodiment of FIG. 1, with the low-volume flush valve in a second, higher position relative to the high-volume flush valve.
Figure 2:
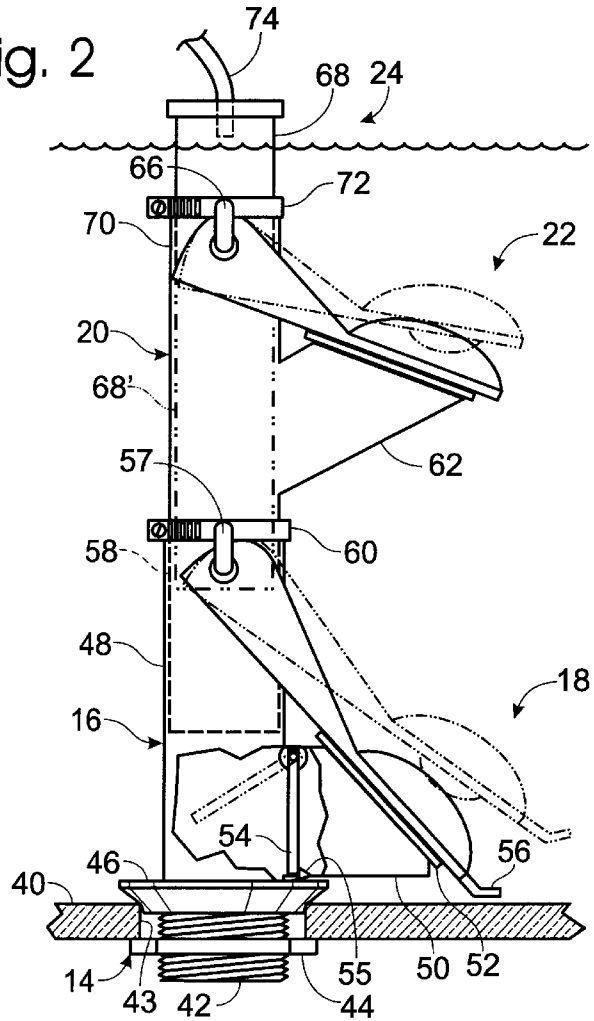
FIG. 2 is a side elevational view of the embodiment of FIG. 1, with the low-volume flush valve in a first, lower position relative to the high-volume flush valve.

FIGS. 2 and 3 show modular valve assembly 10 in more detail. As mentioned above, modular valve assembly 10 includes a base 14 configured to couple the moldular valve assembly 10 to the bottom 40 of toilet tank 12 and to pass water out of the toilet tank. In the depicted embodiment, base 14 takes the form of a spud, but it will be appreciated that base 14 may have any other suitable configuration. Base 14 includes a threaded portion 42 that fits through toilet tank outflow hole 43, and is secured to bottom 40 of toilet tank 12 with a nut 44. The connection may be sealed with a gasket 46.

Lower outflow tube section 16 is connected to base 14, and includes a hollow upright portion 48 to which upper outflow tube section 20 is coupled. Upright portion 48 supports upper outflow tube section 20 above base 14, and also channels water discharged through low-volume flush valve 22 through toilet tank outflow hole 43. Upright portion 48 may have any suitable configuration. For example, upright portion 48 may have a bend that offsets upper outflow tube section 20 relative to base 14. In the depicted embodiment, however, upright portion 48 extends directly above base 14, such that the hollow interior of upright portion 48 is positioned directly above and in line with the opening in base 14. In this configuration, water discharged through low-volume flush valve 22 can pass straight down through lower outflow tube section 16 without any horizontal deflection, and thus may increase the continuous maximum water volume and velocity of the flush.

Lower outflow tube section 16 also includes a lower side tube 50 extending away from upright portion 48, which connects high-volume flush valve 18 to upright portion 48. Lower side tube 50 may have any suitable configuration, and may be positioned at any desired location on lower outflow tube section 16. In the depicted embodiment, lower side tube 50 is oriented generally parallel to toilet tank bottom 40, and is positioned directly adjacent the toilet tank bottom. This places the lower edge of the lip 52 of high-volume valve 18 very close to the bottom of toilet tank, and thus permits essentially all of the water to drain from the tank when the high-volume flush valve is opened. While high-volume flush valve is connected to upright portion 48 with lower side tube 50 in the depicted embodiment, it will be appreciated that high-volume flush valve may also be attached directly to the side of upright portion 48, without the use of lower side tube 50.

When water is discharged from toilet tank 12 via low-volume flush valve 22, it is possible that some water may flow into lower side tube 50. To direct water discharged through low-volume flush valve 22 away from the opening of lower side tube 50, valve system 10 may include a water flow diverter disposed in the interior of lower outflow tube section 16. This water flow diverter may have any suitable design. In the depicted embodiment, the water flow diverter takes the form of a plate 54 attached with a hinge to the joint between lower side tube 50 and upright portion 48, within the hollow interior of lower outflow tube section 16. In the absence of water flowing through lower side tube 50, plate 54 hangs downward across the opening to lower side tube 50, as shown in solid lines in FIG. 2. When water is discharged through low-volume flush valve 22, plate 54 blocks the opening of lower side tube 50, and thus prevents water from flowing into the lower side tube. A stop is positioned in lower side tube 50 to prevent plate 54 from swinging into lower side tube 50 when water is flushed through low-volume flush valve 22.

In contrast, when water is flushed through high-volume flush valve 18, plate 54 is pushed away from the high-volume flush valve by the water, as shown in dashed lines in FIG. 2. This allows the water to flow out of side tube 50 and out of toilet tank 12. Alternatively, the water flow diverter may take the form of a stationary barrier 59 that extends partially over the opening of lower side tube 50, as shown in FIG. 3.

High-volume flush valve 18 is configured to cover the end of lower side tube 50 to control the discharge of water through the lower side tube. High-volume flush valve 18 is thus positioned at the free end of lower side tube 50, and is pivotally anchored to a pair of arms 57 located on upright portion 48. In the depicted embodiment, high-volume flush valve 18 is a flapper valve, but may also be any other suitable type of valve. High-volume flush valve 18 may include a seal extension 56 that extends past lower lip 52 of the high-volume flush valve when the high-volume flush valve is in the closed position, shown in solid lines in FIG. 2. Seal extension 56 is configured to help prevent the opening of high-volume flush valve 18 by water flushed through low-volume flush valve 22 by increasing the total water pressure against the high-volume flush valve when the high-volume flush valve is closed.

As mentioned above, upper outflow tube section 20 is slidably coupled to upright portion 48 of lower outflow tube section 16. This allows the height of low-volume flush valve 22 to be quickly and easily adjusted relative to the height of high-volume flush valve 18. FIG. 2 shows low-volume flush valve 22 in a first, lower position relative to high-volume flush valve 18, and FIG. 3 shows the low-volume flush valve in a second, higher position. Note that low-volume flush valve 22 is farther from the surface of the water in the toilet tank in FIG. 2, causing more water to flow out of the high-volume valve when it is opened. Another advantage of the use of a slidable joint is that the joint allows the height of low-volume flush valve to be chosen from a continuous range of possible heights. The portion of lower outflow tube section 16 that receives the upper outflow tube section 20 may be referred to as a connecting portion, and may be configured also to receive overflow tube 68 to form a single flush-volume configuration, as described in more detail below.

The construction of the slidable joint between lower outflow tube section 16 and upper outflow tube section 20 is shown in FIGS. 2 and 3. Upper outflow tube section 16 includes an elongate neck 58 configured to fit within upright portion 48 of lower outflow tube section 20 such that it may be slid into or out of the lower outflow tube section. Elongate neck 58 may have any desired length. Generally, a longer elongate neck 58 provides for a greater range of height adjustability for low-volume flush valve 22. However, if elongate neck 58 has too great a length, it may interfere with the flow of water through lower side tube 50. In the depicted embodiment, elongate neck 58 is long enough to just reach the top of lower side tube 50 when it is fully extended into lower outflow tube section 16. The position of upper outflow tube section 20 relative to lower outflow tube section 16 may be fixed with a locking collar 60. In the depicted embodiment, locking collar 60 is a worm-drive clamp, but upper outflow tube section 20 may be fixed to lower outflow tube section 16 with any other desired locking device. Furthermore, other suitable methods for fixing upper outflow tube section 16 in position relative to lower outflow tube section 20, such as a friction mechanism using an O-ring seal, may also be used.

In addition to elongate neck 58, upper outflow tube section also includes an upper side tube 62 and the aforementioned overflow tube 24. Upper side tube 62 connects low-volume flush valve 22 to upright portion 48, and provides a path for water to flow from low-volume flush valve 22 into elongate neck 58. Upper side tube 62 may have any suitable configuration, and may be located in any desired position on upper outflow tube section 16. In the depicted embodiment, lower side tube 62 extends diagonally upward from elongate neck 58. Low-volume flush valve 22 is positioned at the upper end of upper side tube 62, and is pivotally attached to a pair of arms 66 located on overflow tube 24. In the depicted embodiment, low-volume flush valve 22 is a flapper valve, but it may also be any other suitable type of valve.

When upper outflow tube section 20 is raised or lowered relative to lower outflow tube section 16, the height of overflow tube 24 also changes. To compensate for this, or to permit the maximum water level of the toilet to be adjusted, overflow tube 24 may have an adjustable height. In the depicted embodiment, overflow tube 24 has a slidable adjustment mechanism, although other mechanisms may be used. A sliding adjustment mechanism is preferable, as it allows the height of overflow tube 24 to be quickly adjusted to any desired height within a range of possible heights. In the depicted embodiment, overflow tube 24 is formed from an upper overflow tube section 68 that fits within a lower overflow tube section 70.

Lower overflow tube section 70 of the depicted embodiment is integral with upper outflow tube section 20, and may include a locking collar 72 for fixing the position of upper overflow tube section 68 relative to lower overflow tube section 70. A toilet bowl refill tube 74 (or other suitable device) may be threaded into overflow tube 24 for refilling the toilet bowl after a flush, or may be placed elsewhere in the toilet tank.

Figure 23:
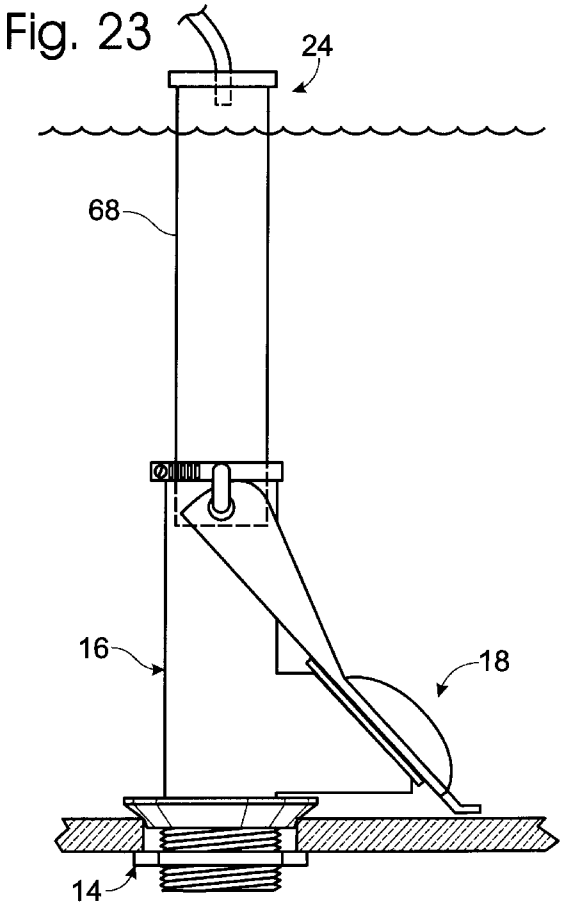
FIG. 23 is a side elevational view of the embodiment of FIG. 1, assembled in a single flush-volume configuration.

Upper overflow tube section 68 may initially be provided with extra length to extend into lower outflow tube section 16. This extra length may facilitate the conversion of modular valve system 10 between single flush-volume and dual flush-volume configurations, as it may allow for the use of a longer overflow tube in a single flush-volume configuration for taller, narrower toilet tanks. However, the extra length of upper overflow tube section 68 may also be cut off (or otherwise removed from) the upper overflow tube section, as indicated at 68' in FIG. 3, where used in a dual flush-volume configuration.

Where a single-volume flush system is desired, upper overflow tube section 68 may be placed directly in lower outflow tube section 16, without the use of upper outflow tube section 20. This is depicted in FIG. 23. In this configuration, the height of the top of upper overflow tube section 68 may be adjusted simply by sliding overflow tube into or out of lower outflow tube section 16. Thus, in this manner, valve assembly 10 may be converted to a single flush-volume valve without the purchase of any additional parts. It will be appreciated that the outer diameter of upper overflow tube section 68 may be configured to be the same as the outer diameter of elongate neck 58 so that the upper outflow tube section 68 fits snugly within lower outflow tube section 16. In this instance, lower overflow tube section 70 may have a may have a slightly larger diameter than elongate neck 58. Alternatively, lower overflow tube section 70 may have substantially the same outer diameter as elongate neck 58. In this configuration, upper outflow tube section 68 may have a slightly smaller outer diameter than elongate neck 58, and may be secured in lower outflow tube 16 by tightening locking ring 60 sufficiently, or through the use of a suitable gasket (not shown).

Figure 4:
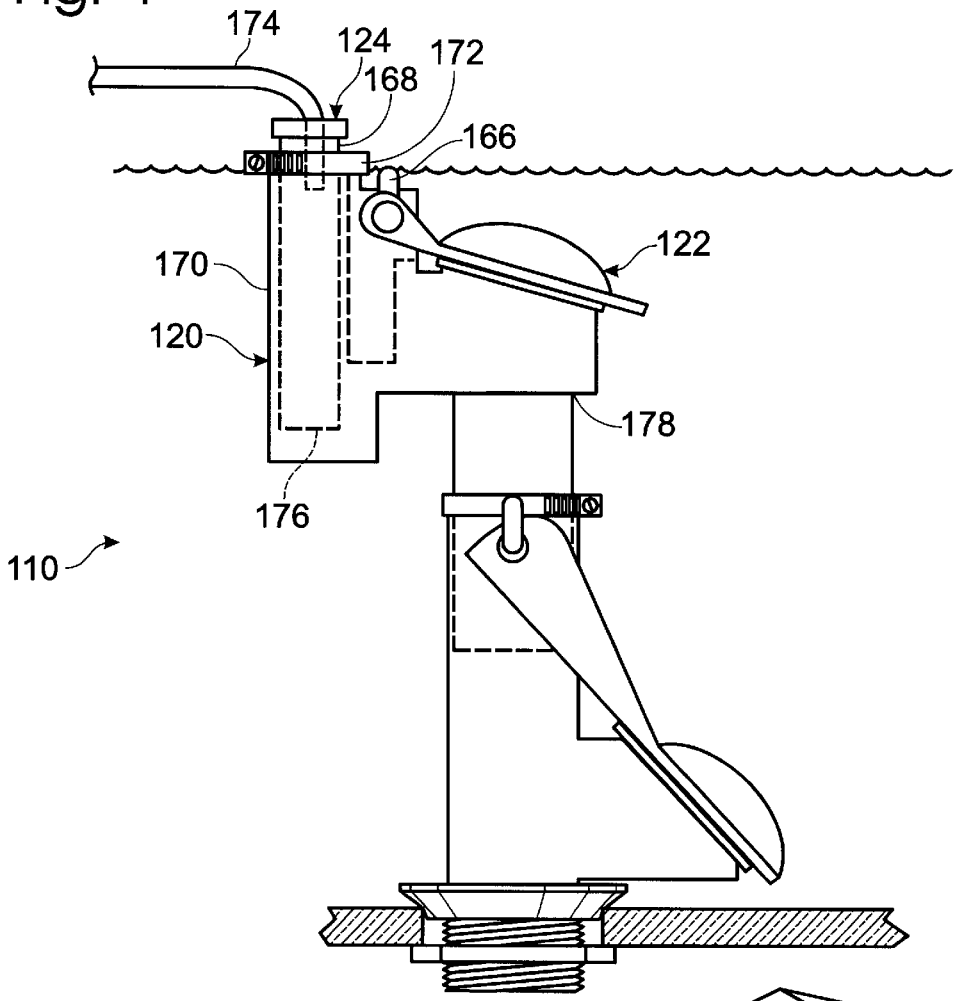
FIG. 4 is a side elevational view of a second embodiment of an outflow valve assembly according to the present invention.

A second embodiment of a modular valve assembly according to the present invention is shown generally at 110 in FIG. 4. Modular valve assembly 110 is similar in appearance and operation to the first embodiment, but utilizes a different upper outflow tube section, indicated at 120. Upper outflow tube section 120 has an offset overflow tube 124, which allows low-volume flush valve 122 to be positioned directly over the base. In this configuration, water flushed through low-volume flush valve 122 passes directly downward from the low-volume flush valve out of the toilet tank, without any horizontal deflection. This may increase the continuous maximum water volume and velocity of the low-volume flush, and thus may lead to a more efficient flush.

Offset overflow tube 124 is formed from an upper overflow tube section 168 slidably coupled to a lower overflow tube section 170. This allows the height of overflow tube 124 to be adjusted, and thus permits the overflow tube height to be changed to compensate for changes in the height of the low-volume flush valve, or to change the maximum water level in the toilet tank. A locking collar 172 may be provided to allow upper overflow tube section 168 to be fixed in position relative to lower overflow tube section 170. A pair of arms 166 may be provided on overflow tube section 120 as a location for the attachment of low-volume flush valve 122. A refill tube 174 for refilling the toilet bowl after a flush may be attached to upper overflow tube section 168.

Positioning overflow tube 124 in an offset position also may allow the overflow tube to have a greater range of adjustability than if it were positioned directly over upper outflow tube section 120. In the embodiment shown in FIG. 4, lower overflow tube section 170 extends below the upper edge 178 of upper outflow tube section 120, permitting the length of upper overflow tube section 168 to be correspondingly increased for a greater range of adjustment.

As with the embodiment of FIGS. 1–3, valve assembly 110 may be converted to a single flush-volume valve configuration by removing upper outflow tube section 120, and attaching an overflow tube assembly such as that shown at 1020 in FIG. 23, described in more detail below. Thus, a user may simply and easily convert valve assembly 110 to a single flush-volume configuration when desired.

Figure 5:
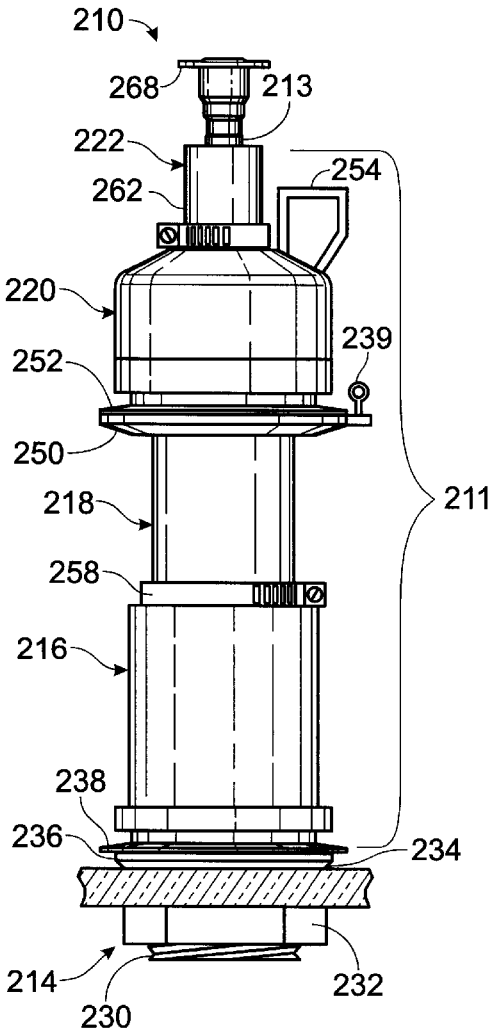
FIG. 5 is a side elevational view of a third embodiment of an outflow valve assembly according to the present invention.
Figure 6:
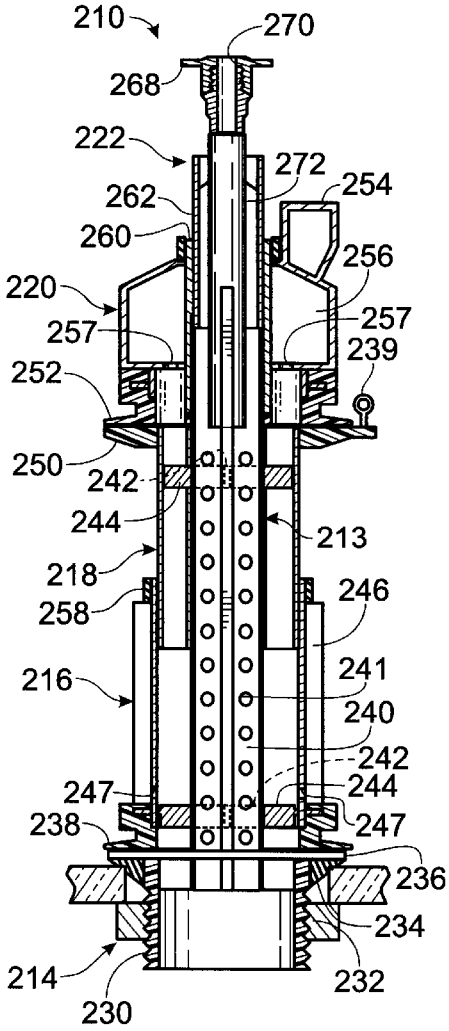
FIG. 6 is a partially sectioned view of the embodiment of FIG. 5, with both valves in closed positions.

FIGS. 5–8 show generally at 210 a third embodiment of a modular valve assembly according to present invention. Rather than a flapper-style valve system, modular valve assembly 210 provides a column-type valve assembly, in which an upright column structure 211 may be lifted directly upward along a guide 213 to open a space between the column structure and the valve base, thus allowing water to flow out of the toilet tank. As shown in FIGS. 5–6, valve assembly 210 includes a base 214 and the aforementioned column structure 211, which is formed of a lower outflow tube section 216, an upper outflow tube section 218, a cap piece 220 and an overflow tube 222. Upper outflow tube section 218 is adjustably coupled to lower outflow tube section 216 to allow the volume of the low-volume flush to be adjusted. Alternatively, cap piece 220 and overflow tube 222 may be used with alone base 214, without lower outflow tube section 216 or upper outflow tube section 218, to form a single flush-volume configuration of modular valve assembly 210.

Base 214 is configured to couple modular valve assembly 210 to the bottom 40 of toilet tank 12 and to pass water out of the toilet tank. In the depicted embodiment, base 214 takes the form of a spud, but it will be appreciated that base 214 may have any other suitable configuration. Base 214 includes a threaded portion 230 that fits through toilet tank outflow hole 43, and is secured to bottom 40 of toilet tank 12 with a nut 232. The connection may be sealed with a gasket 234.

Base 214 also includes an upper surface 236 that forms part of the high-volume flush valve. In the depicted embodiment, upper surface 236 is a flat surface configured to form a watertight seal with a gasket 238 situated on lower outflow tube section 216. The high-volume flush valve is opened by separating gasket 238 from upper surface 236 of base 214, permitting water to drain from toilet tank 12 through the base. The gasket and upper surface are separated by pulling upwardly on a ring 239 attached to upper outflow tube section 218, thus lifting column structure 211 along guide 213.

As described above, guide 213 extends upwardly from base 214 and guides the movement of column structure 211 when the lower outflow tube section is raised or lowered. Guide 213 may have any suitable configuration. In the depicted embodiment, guide 213 is formed from four upwardly-extending ribs 240 arranged in a cross-like configuration, but may have any other suitable configuration. Guide 213 may also include a series of holes or raised portions 241 to reduce the noise of water flowing down guide 213 as the toilet bowl is refilled after flushing.

Lower outflow tube section 216 includes a ring 242 that surrounds guide 213 to hold column structure 211 centered on guide 213. Ring 242 is attached to the inside of lower outflow tube section 216 with one or more plastic spacers 244, and travels along guide 213 as lower outflow tube section 216 is moved up or down to open or close the high-volume flush valve, respectively. Modular valve assembly 210 may have as many rings 242 as desired for guiding lower outflow tube section 216 (and upper outflow tube section 218) along guide 213. Two rings 242 are shown in the depicted embodiment.

Lower outflow tube section 216 also includes a float 246. Float 246 is formed from a hollowed, air-containing chamber surrounding lower outflow tube section 216. When the high-volume valve is opened, float 246 holds the high-volume valve open until the water drains to the level of upper surface 236 of base 214. One or more small holes 247 may be formed in the bottom of float 246 to allow for the equalization of pressure between the float and the outside atmosphere. Holes 247 open into the hollow interior of lower outflow tube section 216 so that any water that may get inside of float 246 will drain out of the toilet tank.

Similar in operation to the high-volume flush valve, the low-volume flush valve of modular valve assembly 210 is formed from the junction of upper outflow tube section 218 and cap section 220. The seal of the low-volume flush valve is formed between the top surface 250 of upper outflow tube section 218 and a gasket 252 attached to the bottom of cap section 220. Separating gasket 252 from top surface 250 lifts cap section 220 along guide 213, and thus opens the high volume valve. A chain attachment ring 254 is disposed on cap section 220 to allow the attachment of a chain or wand so that cap section 220 may be lifted with wand 26, or another suitable mechanism. A float 256 formed in cap section 220 holds the low-volume flush valve open until water drains to the level of top surface 250. One or more small holes 257 may be provided to allow the pressure within float 256 to equalize with the outside atmosphere.

To allow the volume of the low-volume flush to be adjusted, upper outflow tube section 218 is adjustably coupled to the upper portion of lower outflow tube section 216. Lower outflow tube section 216 and upper outflow tube section 218 may be adjustably coupled in any desired manner. For example, the upper portion of lower outflow tube section 216 and the lower portion of upper outflow tube section 218 may have complementary threads so that the height of the upper outflow tube section may be adjusted by turning the upper outflow tube section. In the depicted embodiment, however, upper outflow tube section 218 is slidably coupled to lower outflow tube section. A suitable locking device, such as a worm drive clamp 258, may be used to fix upper outflow tube section 218 in position relative to lower outflow tube section 216.

Overflow tube 222 is attached to the top portion of cap section 220, and may have any suitable design for allowing excess water to drain from toilet tank 12. For example, overflow tube 222 may have a fixed height relative to cap section 220. In the depicted embodiment, however, overflow tube 222 has an adjustable height. This allows the height of the overflow tube to be adjusted to compensate for adjustments in the height of the low-volume flush valve, and also to allow the maximum water level in the toilet tank to be adjusted.

Overflow tube 222 is formed from a lower overflow tube section 260 slidably coupled to an upper overflow tube section 262. Lower overflow tube section 260 of the depicted embodiment is formed from a molded tubular inner section of cap section 220, but may also be formed from a separate tubular piece. Lower overflow tube section 260 preferably has a diameter that closely fits guide 213 so that guide 213 holds cap section 220 centered over upper outflow tube section 218 and lower outflow tube section 216. Upper overflow tube section 262 fits snugly within, or outside of, the inner diameter of lower overflow tube section 260 so that it may be slid upward or downward relative to the lower overflow tube section to adjust the height of overflow tube 222. A locking device, such as a worm drive clamp 266 (or any other suitable device), may be used to fix the height of upper overflow tube section 262 relative to lower overflow tube section 260.

To prevent cap piece 220 from being moved above the top of guide 213, guide 213 includes a stop 268 with a greater diameter than the diameter of upper overflow tube section 262. Stop 268 may be attached to guide 213 in any suitable manner. In the depicted embodiment, cap 268 is connected to guide 213 with a threaded connection.

Stop 268 may include a refill hole 270 configured to accept a toilet bowl refill line. In the depicted embodiment, guide 213 also includes a refill tube 272 extending downwardly from refill hole 270 past the level of top surface 250 of upper outflow tube section 218. This helps to prevent water flowing through refill hole 270 from compromising the integrity of the seal of the low-volume flush valve.

Figure 7:
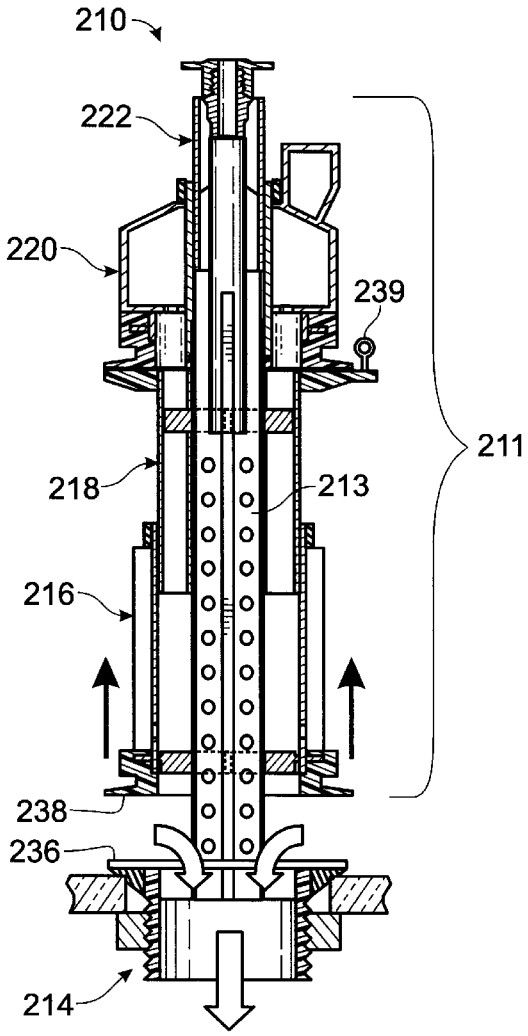
FIG. 7 is a partially sectioned view of the embodiment of FIG. 5, with the high-volume flush valve in an open position.
Figure 8:
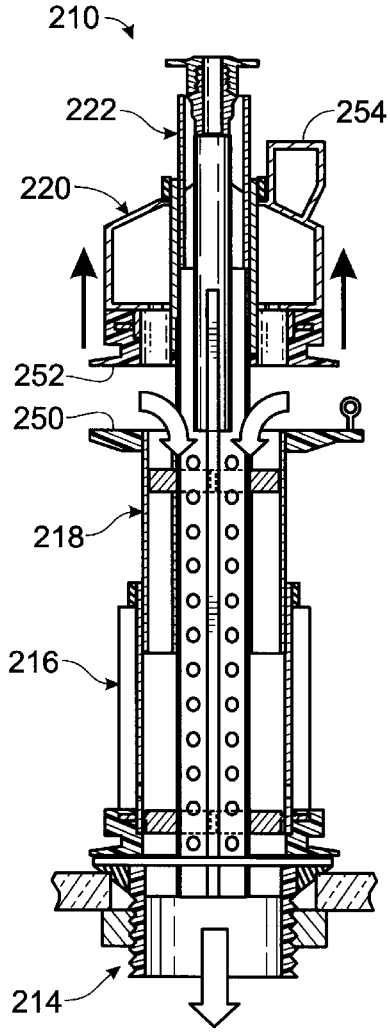
FIG. 8 is a partially sectioned view of the embodiment of FIG. 5, with the low-volume flush valve in an open position.

FIGS. 7 and 8 illustrate operation of the dual flush-volume configuration of modular valve assembly 210. Referring to FIG. 7, when the entire column structure 211 is lifted from base 214, water can flow through the high-volume flush valve formed by the gap between the lower outflow tube section and the base, thus emptying essentially the whole toilet tank. Next, referring to FIG. 8, when cap section 220 is lifted from upper outflow tube section 218, water can flow through the low-volume flush valve formed by the gap between the upper outflow tube section and the cap section, thus only partially emptying the toilet tank.

Many types of flush mechanisms may be used to operate a toilet valve assembly according to the present invention. For example, a double handle system may be used, in which each outflow valve is operated by a separate handle. FIGS. 9–13 illustrate another suitable flush mechanism 310, which utilizes a single handle 28 that operates both flush valves. Ordinarily, handle 28 opens only the low-volume flush valve. However, flush mechanism 310 includes a button 34 that may be depressed to allow operation of the high-volume flush valve with handle 28.

Figure 9:
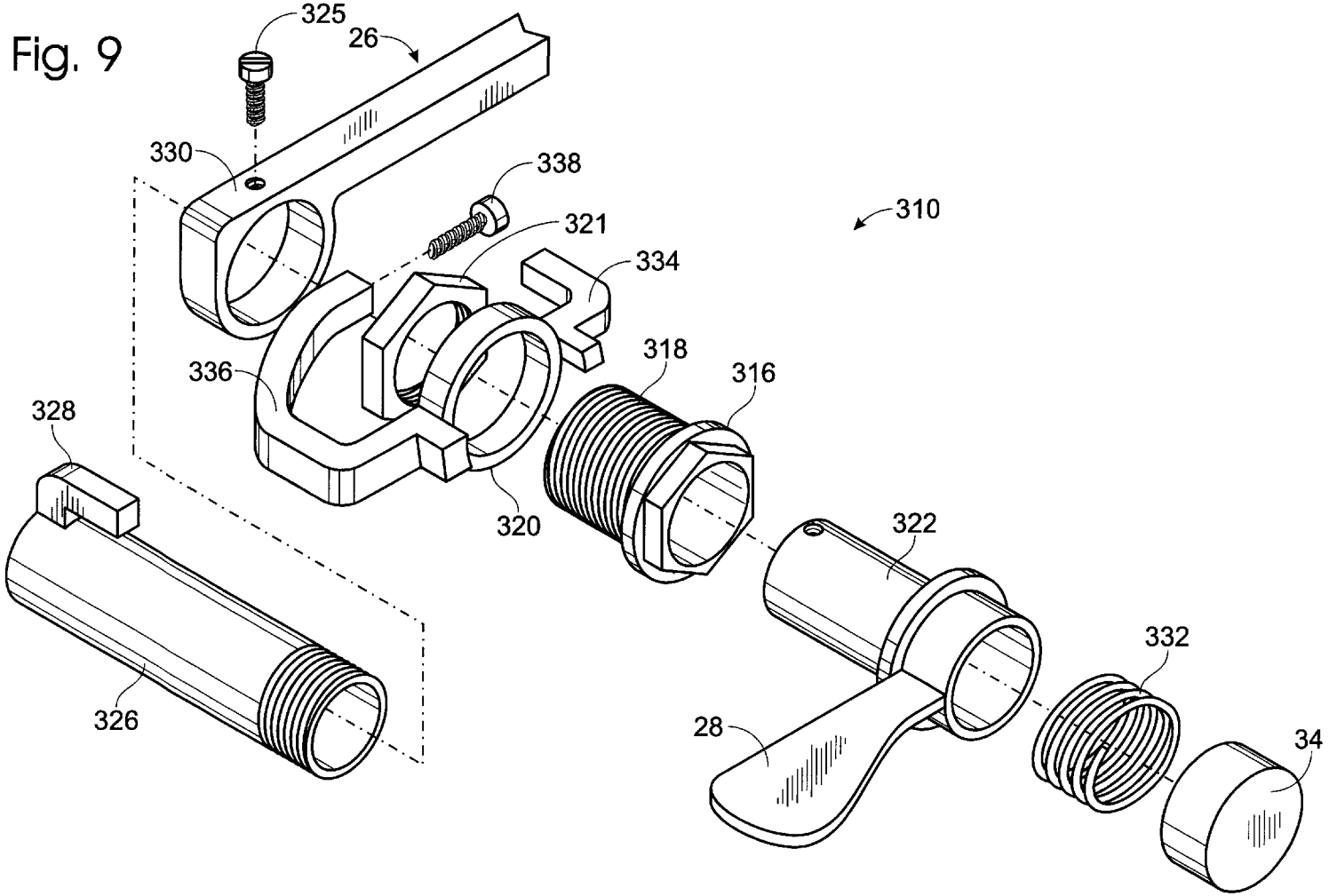
FIG. 9 is an exploded isometric view of a first embodiment of a flush mechanism suitable for use with an outflow valve assembly of the present invention.
Figure 10:
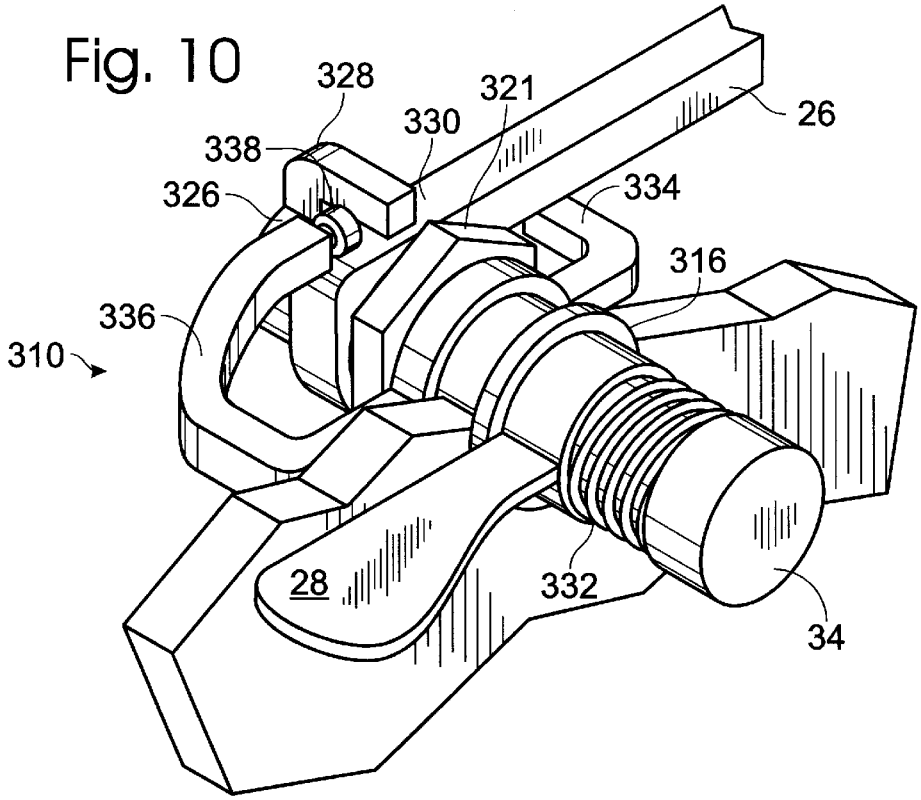
FIG. 10 is an isometric view of the flush mechanism of FIG. 9.
Figure 11:
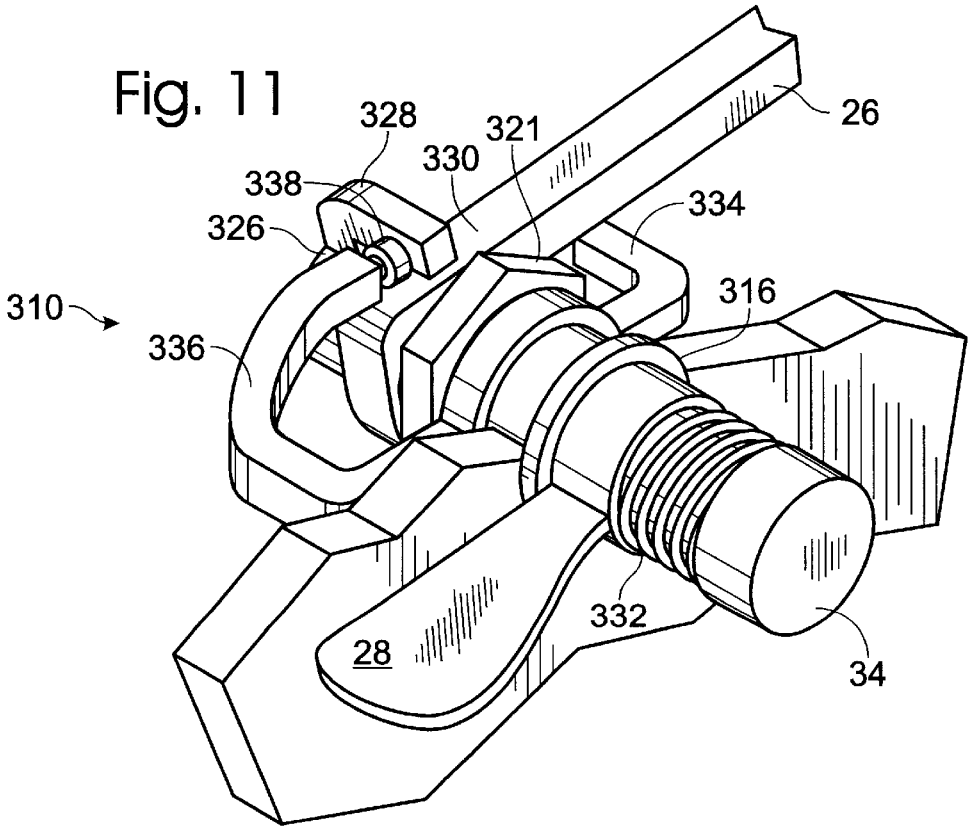
FIG. 11 is an isometric view of the flush mechanism of FIG. 9, illustrating the operation of the handle for a low-volume flush.

The construction of flush mechanism 310 is shown in detail in FIG. 9. Handle 28 attaches to the toilet tank with a cylindrical bushing 316 configured to extend through a hole in the toilet tank wall. One end 318 of bushing 316 is threaded so that bushing 316 can be attached to the toilet tank with a nut 321. Nut 321 also holds a locking mechanism 320 in place, described in more detail below.

Handle 28 is fixed to one end of a hollow rotatable member 322 that extends through bushing 318. A flush wand 26 is attached to the other end of hollow rotatable member 322 with a screw 325, or other suitable fastener. Thus, pushing handle 28 downwardly causes flush wand 26 to rotate upwardly and pull open any valves connected to the flush wand.

As described earlier and shown in FIG. 1, flush wand 26 is connected to both the low-volume flush valve and the high-volume flush valve. Flush wand 26 is connected to the low-volume flush valve with a first, shorter connector 327, and to the high-volume flush valve with a second, longer connector. Thus, when handle 28 is pushed, the low-volume flush valve is opened after a first, lesser amount of rotation of rotatable member 322. The high-volume flush valve is opened only after rotatable member 322 travels through a second, greater amount of rotation.

To prevent handle 28 from rotating fully and opening the high-volume flush valve during ordinary use, flush mechanism 310 may include a high-volume flush control. The high-volume flush control typically has at least two possible states: a first state in which the opening of the high-volume flush valve is prevented, and a second state in which the opening of the high-volume flush valve is enabled. The first state will typically be the default state of the flush mechanism. Thus, a user's reflexive pushing of handle 28 will result in a low-volume flush. In contrast, the user generally must make a cognitive step in order to operate the high-volume flush. For example, in the depicted embodiment, the high-volume flush control prevents handle 28 from rotating far enough to open the high-volume flush valve unless button 34 is depressed while pushing on handle 28.

The high-volume flush control includes a slidable member 326 extending through the interior of wand rotation tube 322. Button 34 is disposed on one end of slidable member 326, and a wand rotation stop 328 is disposed on the other end. When button 34 is not depressed, wand rotation stop 328 extends snugly over the top of flush wand 26. This is the first state of the high-volume flush control of flush mechanism 310. The top surface 330 of flush wand 26 is flat, causing wand rotation stop 328 to rotate when the flush wand is rotated. When button 34 is depressed, however, wand rotation stop 328 is pushed away from top surface 330 of flush wand 26. Thus, slidable member 326 thus is not rotated with the wand. This is the second state of the high-volume flush control of flush mechanism 310. A spring 332 may be disposed around wand rotation lock shaft 326 to bias wand rotation stop 328 into the first state by pushing against the outside of the toilet tank.

The rotational travel path of flush wand 26 is limited by two appendages on locking mechanism 320. First, locking mechanism 320 has a wand rest support 334 that holds flush wand 26 in the rest position when handle 28 is not being operated. Second, locking mechanism 320 has a wand rotation stopping member 336. Wand rotation stopping member 336 is configured to be a barrier to the rotation of flush wand 26 past the point at which the low-volume flush valve is opened, unless button 34 is depressed. As described above and illustrated in FIGS. 10–11, when button 34 is not depressed, wand rotation stop 328 turns with flush wand 26. Thus, wand rotation stop 328 contacts wand rotation stopping member 336 after flush wand 26 has been rotated far enough to open the low-volume valve, and thus prevents the flush wand from being turned further. Wand rotation stopping member 336 may include an adjustment mechanism, typically a small screw 338, to allow the exact stop position of flush wand 26 to be fine-adjusted.

Figure 12:
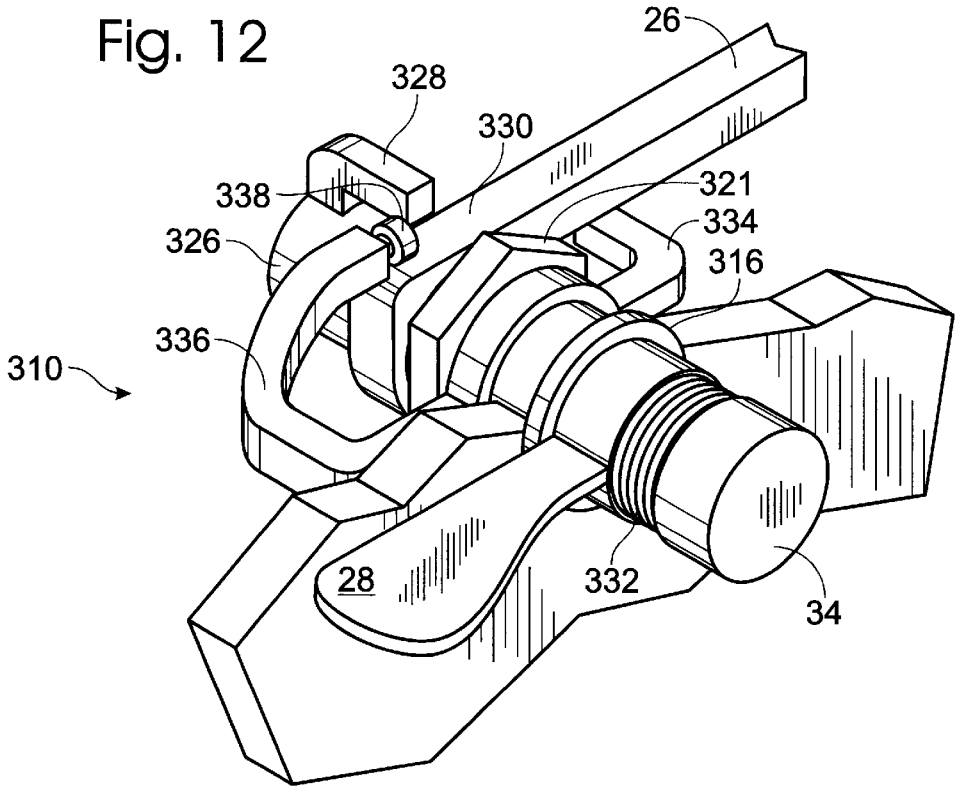
FIG. 12 is an isometric view of the flush mechanism of FIG. 9, illustrating the operation of the release button for a high-volume flush.
Figure 13:
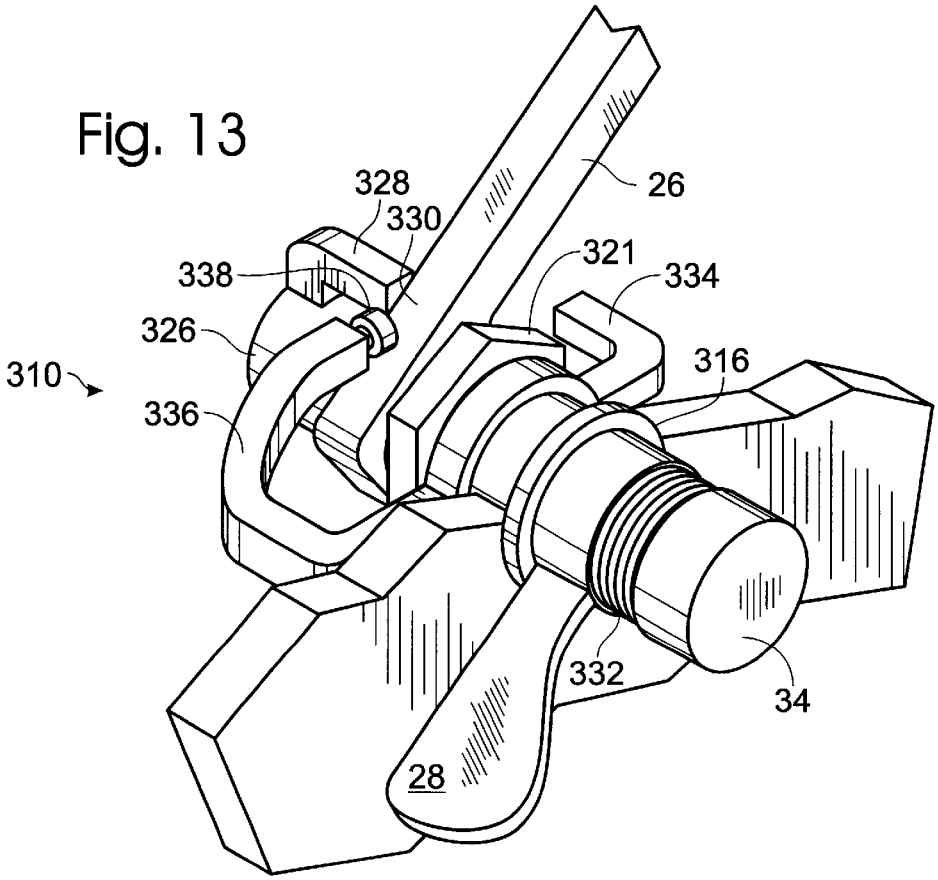
FIG. 13 is an isometric view of the flush mechanism of FIG. 9, illustrating the operation of the handle for a high-volume flush.

In contrast, when button 34 is depressed, wand rotation stop 328 is disengaged from flush wand 26, and does not turn with the wand. It thus does not contact wand rotation stopping member 336 as handle 28 is pushed, and does not stop rotation of flush wand 26. This is shown in FIGS. 12–13. In this instance, flush wand 26 is free to turn far enough to open the high-volume flush valve and to thus allow the entire toilet tank to drain. Once the toilet tank has drained, flush wand 26 returns to its rest position against wand rest support 334, and wand rotation stop 328 is moved back into position over flush wand 26 by spring 332, readying the toilet for a low volume flush.

Figure 14:
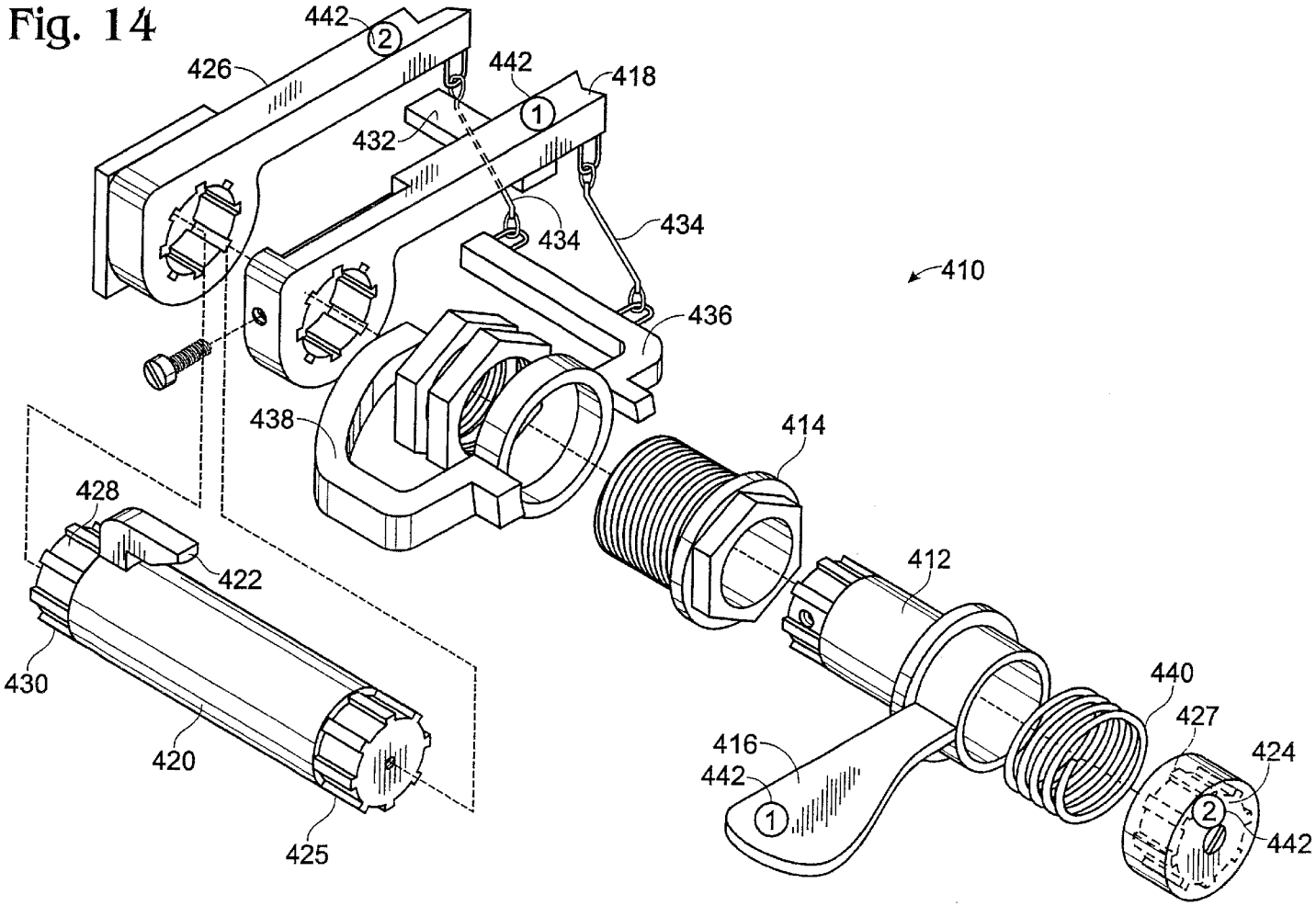
FIG. 14 is an exploded isometric view of a second embodiment of a flush mechanism suitable for use with an outflow valve assembly of the present invention.

FIG. 14 illustrates a second embodiment of a flush mechanism suitable for use with a dual-flush valve assembly, generally at 410. Flush mechanism 410 is similar to flush mechanism 310 in many aspects. For example, flush mechanism 410 includes a hollow rotatable member 412 that extends through a bushing 414 configured to be mounted to the toilet tank wall. A handle 416 is attached to one end of rotatable member 412, and a first flush wand 418 is attached to the other end of rotatable member 412.

Furthermore, flush mechanism 410 also has a high-volume flush control. The high-volume flush control includes a slidable member 420 that extends through the hollow interior of rotatable member 412. A wand rotation stop 422 is attached to one end of slidable member 420, and a button 424 may be attached to the other end of the slidable member. Button 424 may be pressed to move wand rotation stop 422 from its first state, positioned over first flush wand 418, to its second state, in which it is not positioned over first flush wand 418. For a more secure fit, slidable member 420 may include raised portions or flutings 425 to mate with complementary flutings 427 within button 424.

Unlike flush mechanism 310, however, flush mechanism 410 includes a second flush wand 426 to open the high-volume flush valve. Second flush wand 426 is mounted to an extension 428 of slidable member 420, which may include flutings 430 to hold second flush wand 426 more securely. Second flush wand is lifted by a lifting member 432 disposed on first flush wand 418 that extends outwardly from the first flush wand. Thus, second flush wand is lifted when first flush wand is lifted by manipulation of handle 416. Lifting member 432 of the depicted embodiment has an elongate, generally flat shape, but it will be appreciated that any other lifting member may be used without departing from the scope of the present invention.

Operation of flush mechanism 410 is similar to that of flush mechanism 310. Depressing handle 416 when wand rotation stop 422 is in the first state causes the wand rotation stop 422 to contact a stopping member 438, thus preventing the high-volume flush valve from being opened. However, when button 424 is depressed, moving wand rotation stop 422 into its second state, the wand rotation stop does not rotate with handle 416, thus permitting the handle to be turned sufficiently far to open the high-volume flush valve. A spring 440 may be provided to bias button 424 outwardly, and thus to bias wand rotation stop 422 into the first state. Also, an elastic cord 434 may be attached between wand rest support 436 and either low-volume flush wand 418, high-volume flush wand 426, or both flush wands to bring the flush wands down to the rest position after a flush is completed. Furthermore, indicator symbols 442 may be molded into handle 416, button 424, and flush wands 418 and 426 to indicate which flush wands are controlled by the handle and button.

Figure 15:
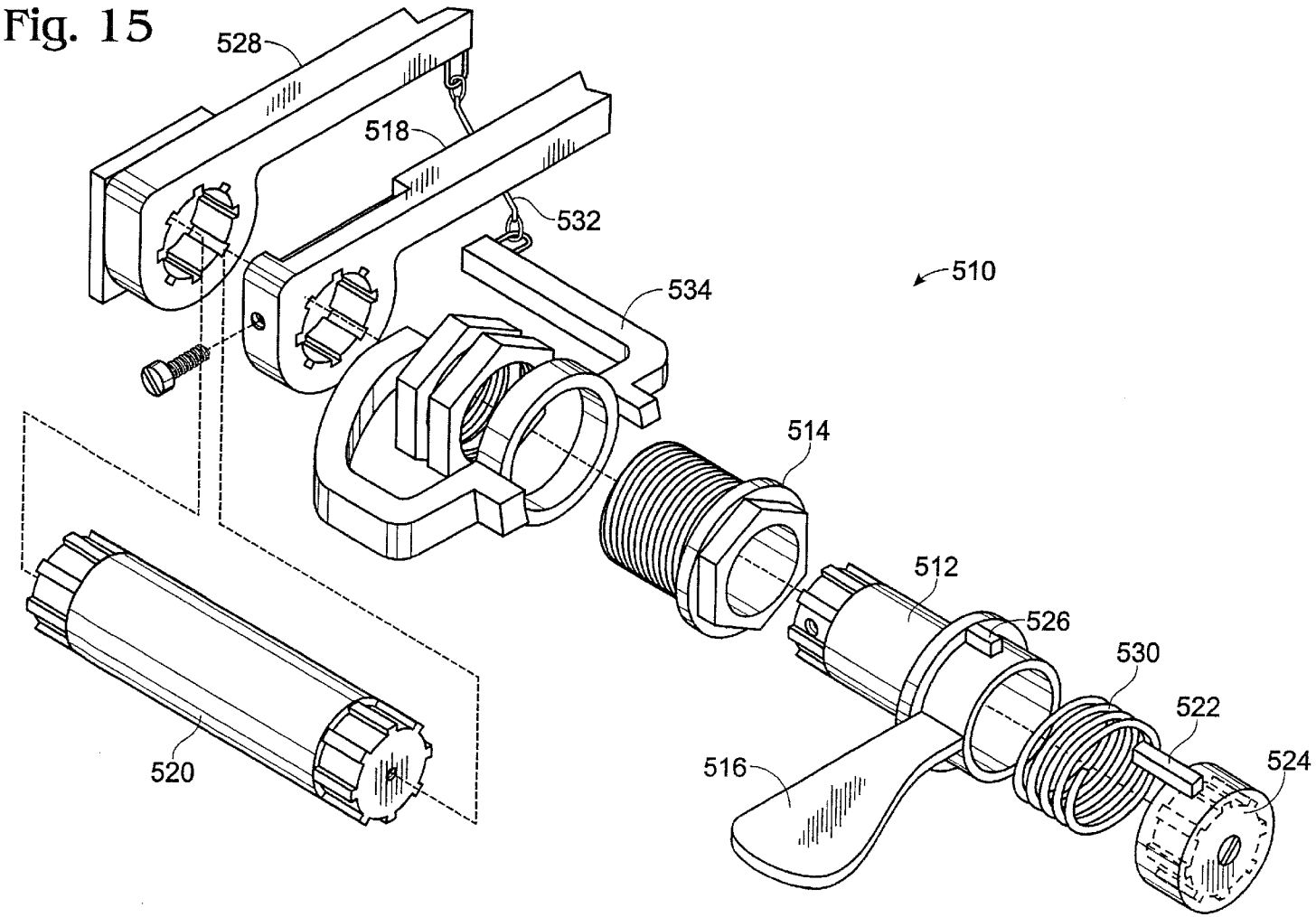
FIG. 15 is an exploded isometric view of a third embodiment of a flush mechanism suitable for use with an outflow valve assembly of the present invention.

FIG. 15 depicts a third embodiment of a flush mechanism suitable for use with a dual-volume flush valve according to the present invention, generally at 510. Flush mechanism 510 is similar to flush mechanisms 310 and 410 in many aspects. For example, flush mechanism 510 includes a hollow rotatable member 512 that extends through a bushing 514 configured to be mounted to the toilet tank wall. A handle 516 is attached to one end of rotatable member 514, and a low-volume flush wand 518 is attached to the other end of rotatable member 514. Flush mechanism 510 also has a high-volume flush control including a slidable member 520 that extends through the hollow interior of rotatable member 512. A high-volume flush wand 528 is disposed on the end of slidable member 520.

However, unlike flush mechanisms 310 and 410, flush mechanism 510 includes a wand rotation engagement bracket 522 attached to a button 524 coupled to the end of slidable member 520. Wand rotation engagement bracket 522 is configured to engage a complementary raised portion 526 on rotatable member 514 to cause slidable member 520 to turn with rotatable member 514 when button 524 is depressed and handle 516 is pushed.

As with the other embodiments described above, flush mechanism 510 has two states. In the first state, when button 524 is not pushed inwardly by a user, wand rotation bracket 522 does not engage raised portion 526 on rotatable member 514 when handle 516 is depressed. Thus, slidable member 520 is not turned with rotatable member 514. However, in the second state, when button 524 is depressed, raised portion 526 engages wand rotation engagement bracket 522 when handle 516 is depressed. This causes slidable member 520 to turn with handle 516, thus lifting high-volume flush wand 528 and causing the high-volume flush valve to be opened. A spring 530 may be included between button 524 and rotatable member 514 to bias wand rotation engagement bracket 522 into the first state. Also, an elastic cord 532 may be attached to high-volume flush wand 528 and another part of flush mechanism, such as a wand rest support 534, to return the high-volume flush to its rest position once the flush is finished.

Figure 16:
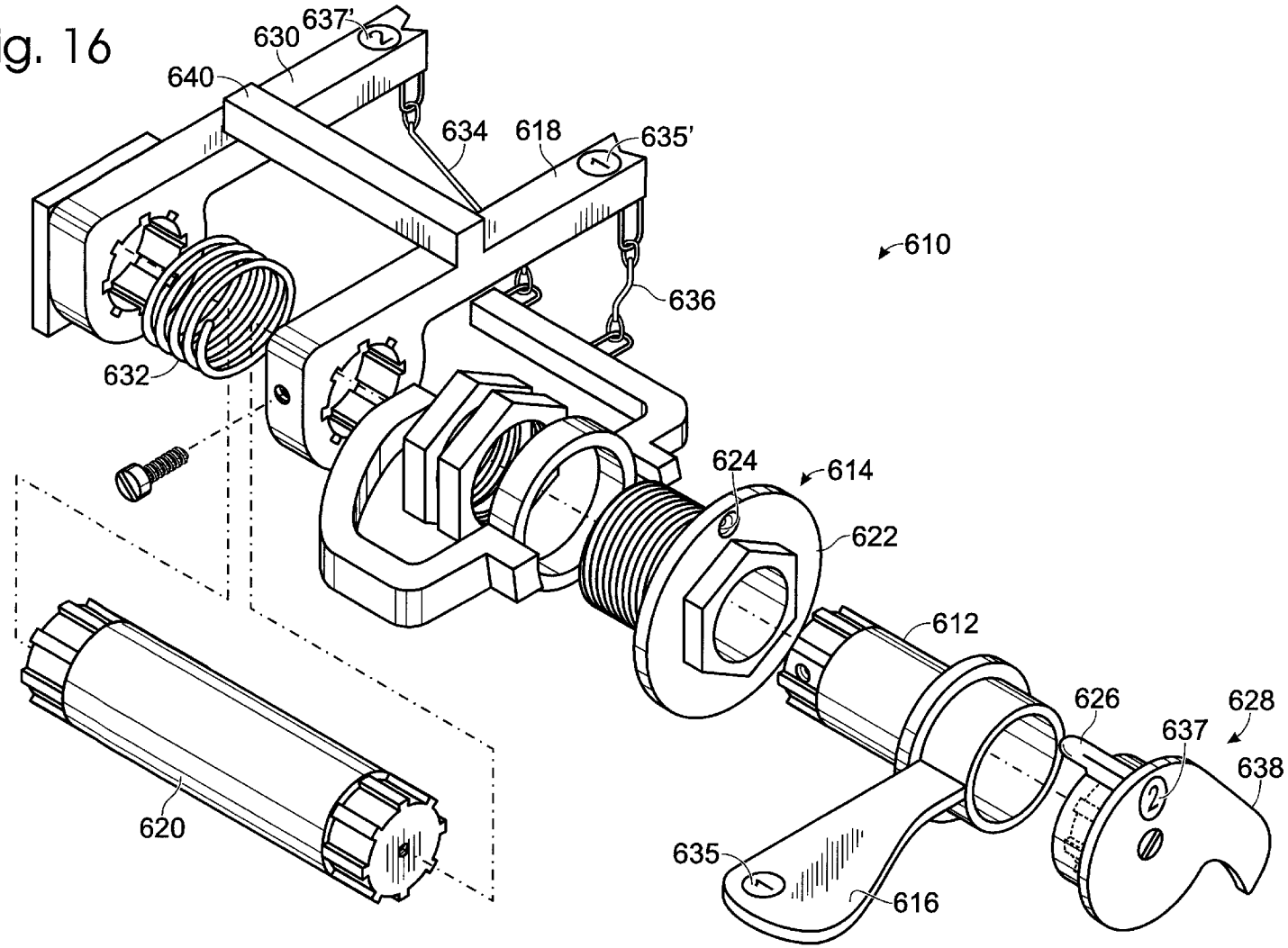
FIG. 16 is an exploded isometric view of a fourth embodiment of a flush mechanism suitable for use with the present invention.

FIG. 16 shows, generally at 610, another embodiment of a flush mechanism suitable for use with a valve assembly of the present invention. Valve assembly 610 has similarities to other embodiments described above. For example, flush mechanism 610 includes a hollow rotatable member 612 that extends through a bushing 614 configured to be mounted to the toilet tank wall. A handle 616 is attached to one end of rotatable member 612, and a low-volume flush wand 618 is attached to the other end of rotatable member 612. Also, a slidable member 620 extends through the hollow interior of rotatable member 612.

However, the high-volume flush control of flush mechanism 610 operates differently from those of the embodiments described above. Wherein the high-volume flush controls of flush mechanisms 310, 410 and 510 are changed between states by pushing a button, flush mechanism 610 is changed between states by pulling slidable member 620 outwardly. The high-volume flush valve may then be opened by turning slidable member 620.

To prevent the high-volume flush valve from being opened when in the first state, bushing 614 includes a flange 622 with a depression 624. Depression 624 is configured to receive a complementary extension 626 disposed on an outer cap piece 628, which is attached to the end of slidable member 620.

The operation of flush mechanism 610 is as follows. Low-volume flush wand 618 may be opened simply by pushing on handle 616. High-volume flush wand 630, however, may not be opened simply by turning cap piece 628. When in the first state, extension 626 is positioned within depression 624, preventing cap piece 628 from being turned. Therefore, cap piece 628 must first be pulled outwardly, and then turned, to lift high-volume flush wand 630. A spring 632 may be included to bias cap piece 628 into the first state, and elastic cords 634 and 636 may be included to pull high-volume flush wand 630 and low-volume flush wand 618, respectively, to their rest positions after use. Also, handles may have a numerical (or other) code to depict visually the correspondence between a selected handle and its associated flush valve. In the depicted embodiment, handle 616 and wand 618 each include a number "1", shown at 635 and 635', respectively. Similarly, cap piece 628 and wand 630 each include a number "2", shown at 637 and 637', respectively.

A lifting member 640 for communicating motion between high volume flush wand 630 and low volume flush wand 618 may be provided if desired. In the depicted embodiment, lifting member 640 is fixed to low volume flush wand 618, and extends over high volume flush wand 630. When low volume flush wand 618 is lifted, lifting member 640 does not affect high volume flush wand 618. However, when high volume flush wand 630 is lifted, the high volume flush wand 630 lifts lifting member 640, which in turn lifts low volume flush wand 618. This causes the low-volume flush valve to open whenever the high-volume flush valve is opened, and may help to decrease the amount of time necessary to empty the toilet tank.

Cap piece 628 may have any suitable shape. For example, cap piece 628 may have a flat configuration with a generally round circumference, or may have a shape like a traditional toilet handle. However, in the depicted embodiment, cap piece 628 includes a contoured extension 638 with a downwardly-curved perimeter configured generally to fit the shape of a finger of a user. In the depicted embodiment, contoured extension 638 is positioned such that a user pulls upwardly on the contoured extension to actuate a high-volume flush, and thus may be more awkward to use than handle 616. This may make it less likely that a user will use the high-volume flush for situations in which it is not needed. However, it will be appreciated that contoured extension 638 may be placed in any other desired position on handle 616.

Figure 21:
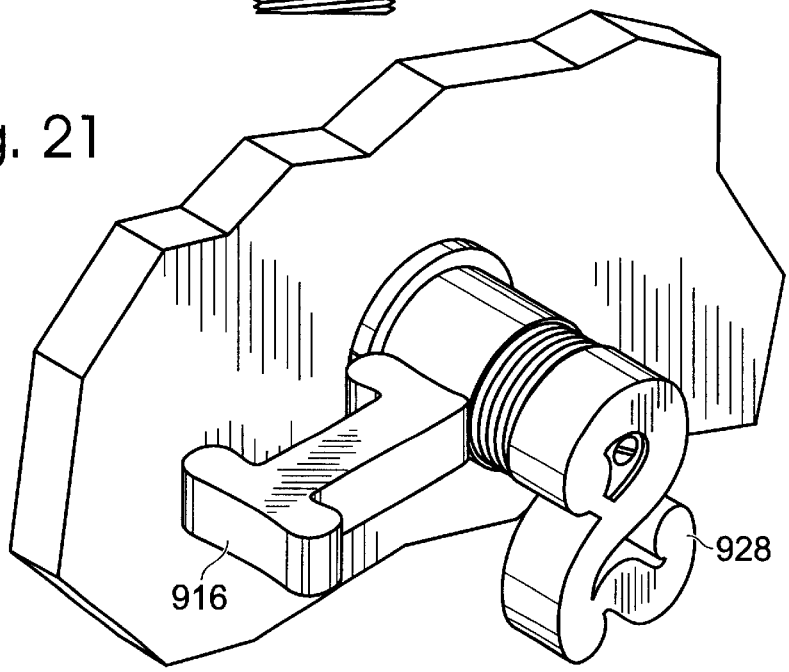
FIG. 21 is an isometric view of an embodiment of an alternate handle mechanism suitable for use with an outflow valve assembly according to the present invention.

FIG. 21 shows another example of suitable configurations for the handle and cap piece. Here, handle 916 and cap piece 928 have shapes that communicate to a user which valve is controlled by each part. For example, handle 916 may have the shape of the number "1" to show that the handle corresponds to low volume flush wand 918, which may be labeled with a number "1", as described above. Likewise, cap piece 928 may have the shape of the number "2" to show that the handle corresponds to high volume flush wand 928, which may be labeled with a number "2", as described above.

The handle 916 and cap piece 928 of FIG. 21 also may indicate which part is used to flush which type of waste. For example, liquid waste is often referred to as "number one" by many people, and especially children, while solid waste is often referred to as "number two." Where handle 916 and cap piece 928 have the shapes shown in FIG. 21, a user, and especially a young user, may easily determine which part is to be used to flush which type of waste. This may allow a child to be trained at a young age to use the water-saving low volume flush to flush liquid wastes.

Figure 17:
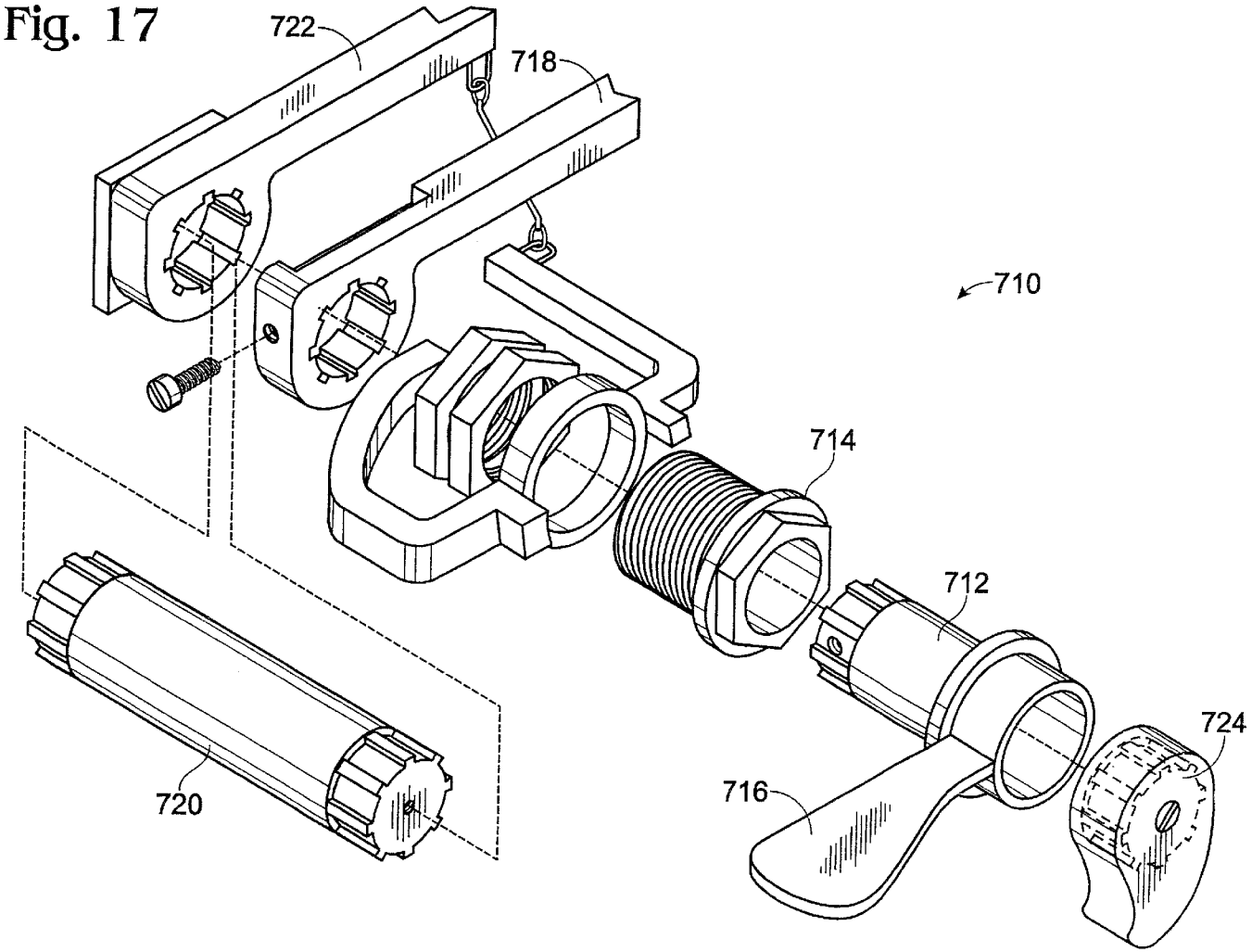
FIG. 17 is an exploded isometric view of a fifth embodiment of a flush mechanism suitable for use with the present invention.

FIG. 17 illustrates generally at 710 another flush mechanism suitable for use with a valve system according to the present invention. Like the other flush mechanisms described above, flush mechanism 710 includes a hollow rotatable member 712 that extends through a bushing 714 configured be mounted to the toilet tank wall. A low-volume flush handle 716 is attached to one end of rotatable member 714, and a low-volume flush wand 718 is attached to the other end of rotatable member 714.

Flush mechanism 710 also includes an elongate member 720 extending through the hollow interior of rotatable member 714. Unlike the corresponding piece in the prior embodiments, however, elongate member 714 is not slidable through the hollow interior of rotatable member 714. Instead, elongate member 720 is independently rotatable.

A high-volume flush wand 722 is attached to one end of elongate member 720, and a high-volume flush handle 724 is attached to the other end. High-volume flush handle 724 has a shape configured to be somewhat more awkward to use than low-volume flush handle 716. Therefore, when a user reflexively operates flush mechanism 710, the user will typically push on low-volume flush handle 716. Likewise, when the user desires a high-volume flush, the user must cognitively decide to operate the somewhat more awkward high-volume flush handle 724. This may be sufficient to prevent the user from flushing a full toilet tank of water in the absence of a decision that a high-volume flush is needed.

Figure 18:
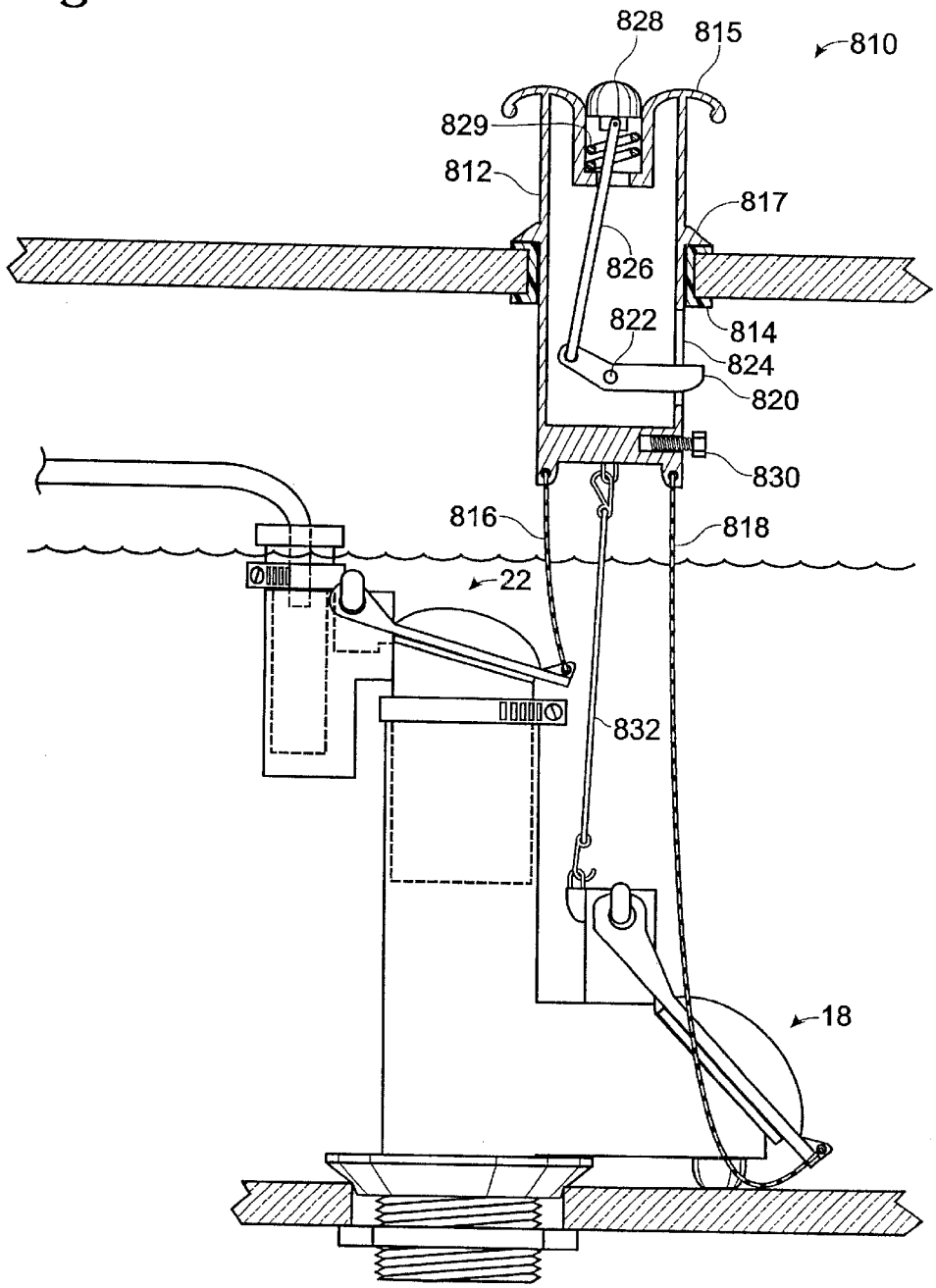
FIG. 18 is a partially-sectioned side view of a sixth embodiment of a flush mechanism suitable for use with the present invention.
Figure 20:
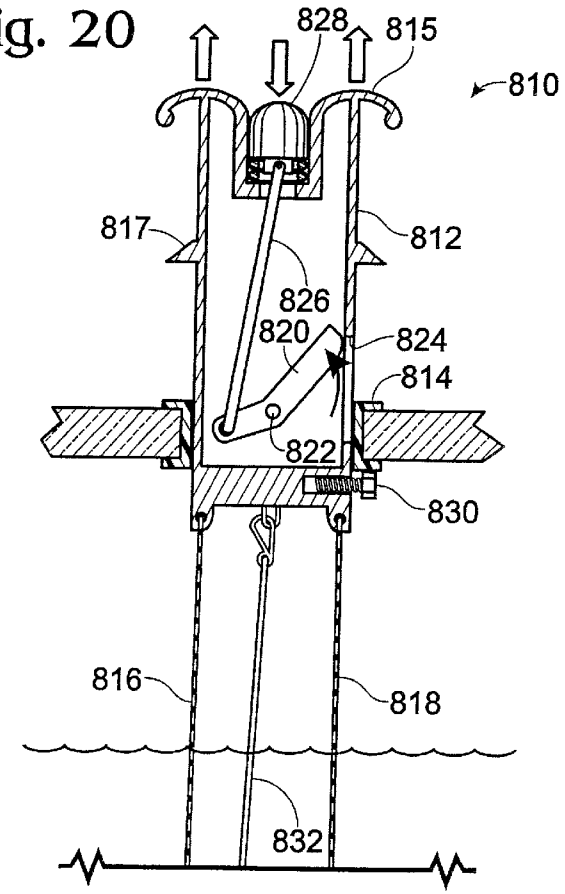
FIG. 20 is a sectional view of the flush mechanism of FIG. 18, illustrating the operation of the flush mechanism for a high-volume flush.
Figure 19:
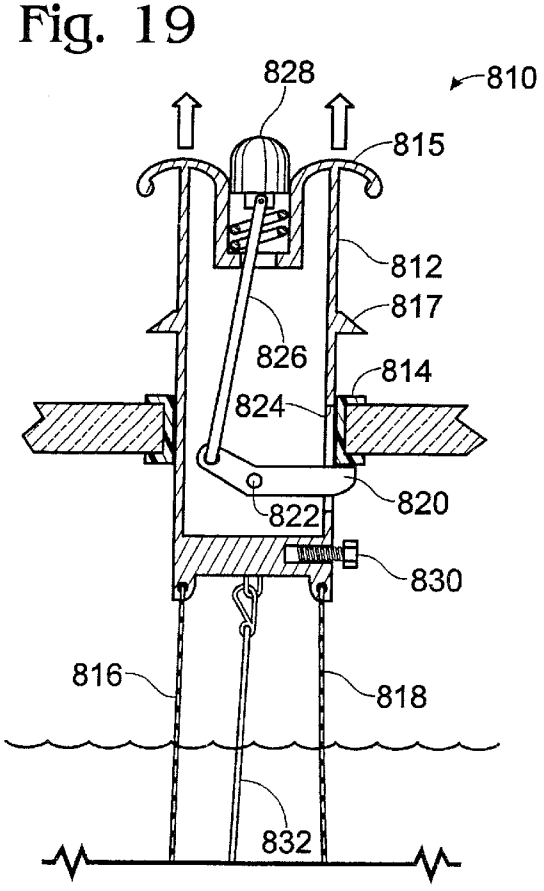
FIG. 19 is a sectional view of the flush mechanism of FIG. 18, illustrating the operation of the flush mechanism for a low-volume flush.

FIGS. 18–20 illustrate yet another flush mechanism suitable for use with the present invention, generally at 810. Rather than employing a handle that operates a rotatable member to lift a flush wand, flush mechanism 810 employs a pullable member 812 that can be pulled a first, shorter distance to open low-volume flush valve 22, or a second, greater distance to open high-volume flush valve 18. Pullable member 812 extends through an opening in the top of toilet tank 12, which may be fitted with a bushing 814. Pullable member 812 of the depicted embodiment takes the form of an elongate, tubular form member, but have any other desired shape and construction. A handle 815 may be provided on pullable member 812 to facilitate use of flush mechanism 810, and a collar 817 may be disposed about the perimeter of pullable member 812 to support pullable member 812 at a desired height relative to the top of toilet tank 12 while at rest.

Pullable member 812 is connected to low-volume flush valve 22 with a first, longer connector 816, and to high-volume flush valve 18 with a second, shorter connector 818. Thus, as pullable member 812 is pulled upwardly, shorter connector 818 opens low-volume flush valve 22 before longer connector 816 is able to open high-volume flush valve 18.

To prevent the inadvertent opening of high-volume flush valve 18, flush mechanism 810 also includes a high-volume flush control having a movable blocking member 820. Blocking member 820 is configured to have both a blocking position, corresponding to a first state of the high-volume flush control, and a retracted position, corresponding to a second state of the high-volume flush control. The blocking position is configured to prevent pullable member 812 from being pulled sufficiently far to open high-volume flush valve 18 unless it is moved to the retracted position.

Blocking member 820 may have any suitable configuration. In the depicted embodiment, blocking member 820 takes the form of a lever mounted to the interior of pullable member 812 with a pivot 822. Blocking member 820 is attached to pivot 822 at a location approximately midway between the ends of blocking member 820, but may be attached at any other suitable point.

One end of blocking member 820 extends outwardly from the interior of pullable member 812 through a slot 824, and the other end is coupled to one end of an actuating member 826. Actuating member 826 is also coupled to a button 828 positioned at the top of pullable member 812. Button 828 may be depressed by a user to move actuating member 826 downward, which in turn pushes on the end of blocking member 820, causing the protruding end of blocking member 820 to pivot and retract through slot 824 into the interior of pullable member 812. A biasing element such as a spring 829 may be included to bias blocking member 820 into the blocking position.

The operation of flush mechanism 810 is illustrated in FIGS. 19–20. Referring first to FIG. 19, when button 828 is not depressed, blocking member 820 extends outwardly from the interior of pullable member 812. When pullable member 812 is pulled upwardly to flush the toilet, but blocking member 820 contacts the inside surface of the top of toilet tank 12 before the high-volume flush valve has been opened, preventing the pullable member from being pulled far enough to open the high-volume flush valve.

Referring next to FIG. 20, when button 828 is depressed, blocking member 820 is retracted into the interior of pullable member 812. Thus, when pullable member 812 is pulled upwardly, blocking member 820 does not contact the inside surface of the top of toilet tank 12, allowing the pullable member to be pulled far enough to open the high-volume flush valve. A stop 830 may be disposed at a desired location on pullable member 812 to prevent the pullable member from being pulled completely through the top of the toilet tank. Furthermore, an elastic cord 832 may be attached to pullable member 812 to return the pullable member to the rest position after use.

Figure 22:
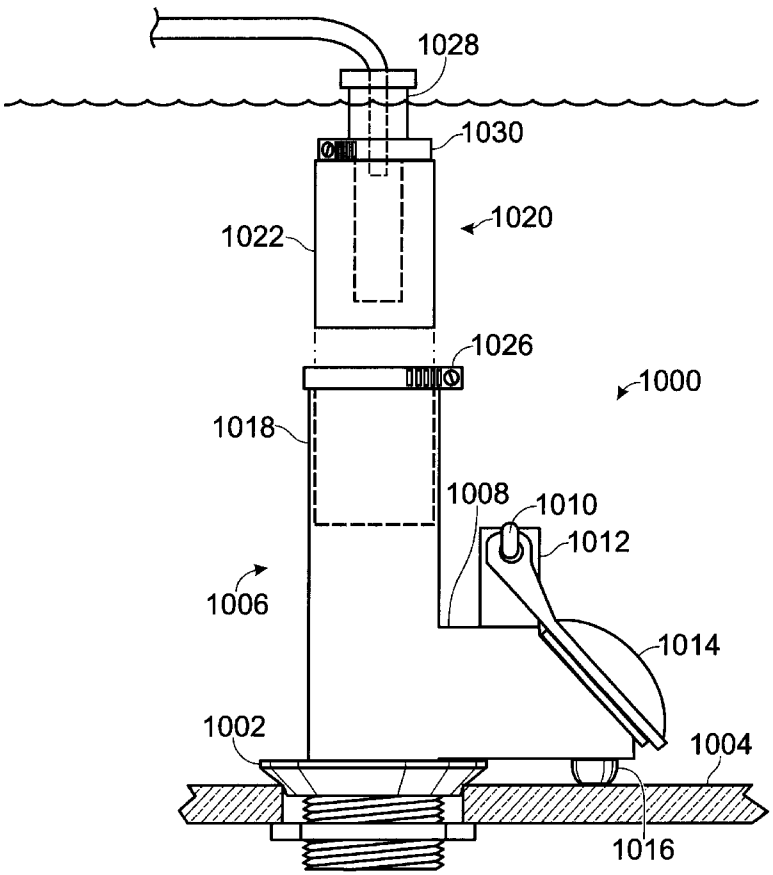
FIG. 22 is a side elevational view of a single-volume configuration of an embodiment of a modular outflow valve assembly according to the present invention.

FIG. 22 shows generally at 1000 another exemplary single flush-volume configuration of a modular outflow valve assembly according to the present invention. Valve assembly 1000 includes a base 1002 configured to be attached to the bottom 1004 of a toilet tank. Valve assembly 1000 also includes a lower outflow tube section 1006. Lower outflow tube section 1006 is similar to those shown above in the embodiments of FIGS. 1–3 and 4. However, side tube 1008 includes a pair of arms 1010 coupled to an upright post 1012 to which a flush valve 1014 is connected. Side tube 1008 also includes a support 1016 to support the side tube against the bottom of the toilet tank. It will be appreciated, however, that the lower outflow tube sections of either of the embodiments of FIGS. 1–3 and 4 may be used in place of the depicted lower outflow tube section 1006.

Lower outflow tube section 1006 also includes a generally upright portion 1018 configured to accept the insertion of an overflow tube assembly 1020. Overflow tube assembly 1020 includes a lower overflow tube section 1022 configured to fit snugly within the inner diameter of upright portion 1018 of lower outflow tube section 1006. The height of lower overflow tube section 1022 may be adjusted by sliding lower overflow tube section 1022 into out of lower outflow tube section 1006, and may be fixed in a desired position via locking collar 1026.

Overflow tube assembly 1020 also includes an upper overflow tube section 1028. Upper overflow tube section 1028 is configured to fit within lower overflow tube section 1022, and to be slidably adjustable with respect to the lower overflow tube section to provide an additional measure of adjustability for the height of the overflow tube assembly. In the depicted embodiment, upper overflow tube section 1028 is configured to fit snugly within a top portion of lower overflow tube section 1022, and may be secured in a desired position with a locking collar 1030. However, it will be appreciated that upper overflow tube section 1028 may have any suitable diameter, and may be secured in place via any suitable mechanism.

Valve assembly 1000 may be converted to a dual flush valve assembly simply by removing overflow tube assembly 1020 from lower outflow tube section 1006, and replacing the overflow tube assembly with an upper outflow tube section having a low volume flush valve. Examples of suitable upper outflow tube sections include, but are not limited to, upper outflow tube sections 20 of FIG. 1 and 120 of FIG. 4. Where upper outflow tube section 20 of FIG. 1 is used, overflow tube assembly 1020 may be inserted into the lower overflow tube section 70 of upper outflow tube section 20. Thus, valve assembly 1000 allows a user to quickly and easily convert the valve between single flush-volume and double flush-volume configurations without having to purchase an entirely new valve assembly, and without having to detach the valve assembly from the bottom of a toilet tank. Furthermore, the embodiments disclosed herein allow a manufacturer to make individual parts that may be used in either single or dual flush-volume configurations.

Figure 24:
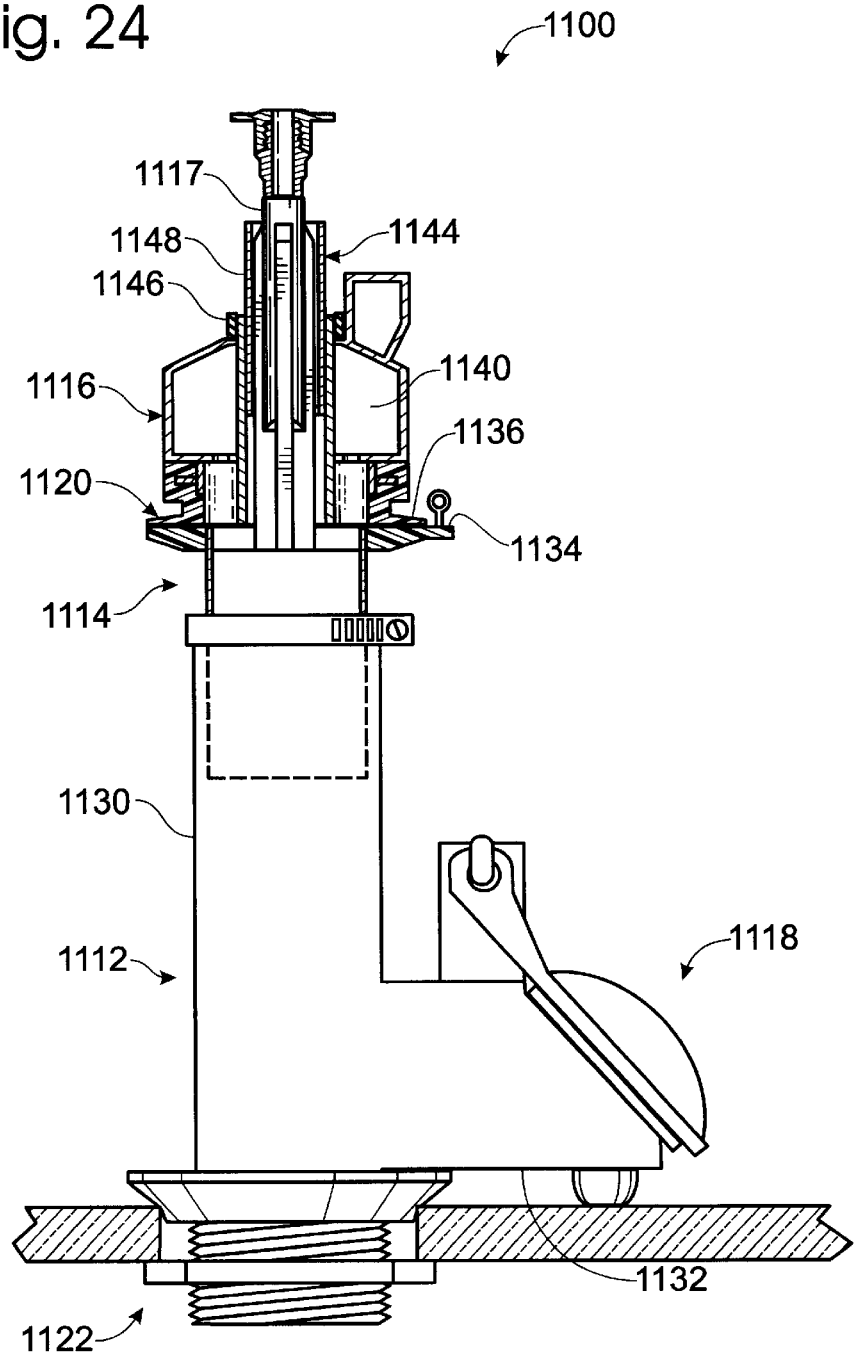
FIG. 24 is a side elevational view of another embodiment of a modular toilet valve assembly according to the present invention.

FIG. 24 shows, generally at 1100, yet another possible configuration of a modular valve system according to the present invention. Valve assembly 1100 is formed from a combination of a lower outflow tube section 1112 similar to that of the embodiment of FIGS. 22–23, and an upper outflow tube section 1114 and cap section 1116 similar to that of the embodiment of FIGS. 5–8. Valve assembly 1110 includes a high-volume flush valve 1118 positioned on lower outflow tube section 1112, and a low-volume flush valve 1120 formed from the junction of upper outflow tube section 1114 and cap section 1116. As with the previous embodiments, upper outflow tube section 1114 is slidably coupled to lower outflow tube section 1112 to allow the height of low-volume flush valve 1120 to be adjusted.

Valve assembly 1110 also includes a base 1122 configured to couple the valve assembly to the bottom of the toilet tank and to pass water out of the toilet tank. Furthermore, a guide 1117 extends upwardly from base 1122 to guide cap section 1116 when it is lifted to discharge water from the toilet tank.

Lower outflow tube section 1112 is similar in appearance and function to the lower outflow tube section of the embodiment of FIGS. 22–23. Lower outflow tube section 1112 is connected to base 1122, and includes a hollow upright portion 1130 to which upper outflow tube section 1114 is coupled. Upright portion 1130 supports upper outflow tube section 1114 above base 1122, and also channels water discharged through low-volume flush valve 1120. It will be appreciated that numerous modifications, including the examples described above for the embodiment of FIGS. 1–3, may be made to lower outflow tube 1112 without departing from the scope of the present invention.

Lower outflow tube section 1112 also includes a side tube 1132 extending away from upright portion 1130. Side tube 1132 connects high-volume flush valve 1118 to upright portion 1130. As with the embodiment of FIGS. 1–3, side tube 1132 is oriented generally parallel to the toilet tank bottom, and is positioned directly adjacent the toilet tank bottom. This places the lower edge of high-volume flush valve 1118 close to the toilet tank bottom, allowing essentially the entire volume of water in the toilet tank to be flushed through high-volume flush valve 1118. Instead of using side tube 1132, high-volume flush valve 1118 may also be positioned directly on the side of upright portion 1130 without departing from the scope of the present invention.

In contrast to high-volume flush valve 1118, low-volume flush valve 1120 is similar in appearance and function to the low volume flush valve of the embodiment of FIGS. 5–8. The seal of low-volume flush valve 1120 is formed between the top surface 1134 of upper outflow tube section 1114 and a gasket 1136 attached to the bottom of cap section 1116. Separating gasket 1136 from top surface 1134 lifts cap section 1116 along guide 1117, and thus opens low-volume flush valve 1120. A float 1140 formed in cap section 1116 holds low-volume flush valve 1120 open until water drains to the level of top surface 1134.

As with the embodiment of FIGS. 5–8, lower outflow tube section 1112 and upper outflow tube section 1114 may be adjustably coupled in any desired manner. In the depicted embodiment, upper outflow tube section 1114 is slidably coupled to lower outflow tube section 1112. The outer diameter of upper outflow tube section 1114 is slightly smaller than the inner diameter of lower outflow tube section 1112. Thus, upper outflow tube section 1114 fits within inner outflow tube section 1112 in a telescopic manner. A suitable locking device, such as a worm drive clamp, may be used to fix upper outflow tube section 1114 in position relative to lower outflow tube section 1112. It will be appreciated that upper outflow tube section 1114 may also fit around the outside of lower outflow tube section 1112 without departing from the scope of the present invention.

To prevent water from overflowing the toilet tank, outflow valve assembly 1110 also has an overflow tube 1144. The height of overflow tube 1144 may be configured to be adjustable so that it may be changed to compensate for changes in the height of the low-volume flush valve, and also to allow the maximum water level in the toilet tank to be adjusted. Overflow tube 1144 is formed from a lower overflow tube section 1146 slidably coupled to an upper overflow tube section 1148. The outer diameter of upper overflow tube section 1148 is slightly smaller than the inner diameter of lower overflow tube section 1146, and thus fits within the lower overflow tube section in a telescopic manner. A locking device, such as a worm drive clamp 1150, may be used to fix the height of upper overflow tube section 1148 relative to lower overflow tube section 1146. Alternatively, upper overflow tube section 1148 may also be configured to fit around the outside of lower overflow tube section 1146 in a telescopic manner.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

I claim:

1. A modular outflow valve assembly for a toilet tank, comprising:

a lower outflow tube section configured to be mounted to a toilet tank to pass water out of the toilet tank, wherein the lower outflow tube section includes a high-volume flush valve configured to flush a first, higher volume of water when opened;

an upper outflow tube section including a low-volume flush valve configured to flush a second, lower volume of water out of the toilet tank when opened, wherein the upper outflow tube section is configured to be attached to the lower outflow tube section to form a dual flush-volume configuration; and an overflow tube, wherein the overflow tube is configured to be attached to the lower outflow tube section in place of the upper outflow tube section to form a single flush-volume configuration.

2. The modular outflow valve assembly of claim 1, wherein the upper outflow tube section is configured to receive attachment of the overflow tube in the dual flush-volume configuration.

3. The modular outflow valve assembly of claim 1, wherein the overflow tube is configured to be inserted into either the lower outflow tube section or the upper outflow tube section to form a slidably adjustable connection.

4. The modular outflow valve assembly of claim 1, wherein the overflow tube has an adjustable height.

5. The modular outflow valve assembly of claim 4, wherein the overflow tube includes a lower overflow tube adjustably connected to an upper overflow tube.

6. The modular outflow valve assembly of claim 5, wherein the upper overflow tube is slidably coupled to the upper overflow tube.

7. A modular outflow valve assembly for a toilet tank, comprising:

a lower outflow tube section, wherein the lower outflow tube section includes a base configured to be coupled to the toilet tank, a generally upright portion extending upward from the base, and a high volume flush valve configured to drain a first, higher volume of water from the toilet tank;

an upper outflow tube section configured to be slidably coupled to the lower outflow tube section, wherein the upper outflow valve section includes a neck portion configured to be coupled to the upright portion on the lower outflow valve section, and a low-volume flush valve configured to drain a second, lower volume of water from the toilet tank; and an overflow tube configured to be selectively attachable to either of the lower outflow tube section and the upper outflow tube section, wherein the overflow tube is attachable to the lower outflow tube section to form a single flush-volume configuration, and wherein the upper outflow tube section is attachable to the lower outflow tube section and the overflow tube is attachable to the upper outflow tube section to form a dual flush-volume configuration.

8. The modular outflow valve assembly of claim 7, wherein the overflow tube is configured to be insertable into each of the lower outflow tube section and the upper outflow tube section.

9. The modular outflow valve assembly of claim 7, wherein the overflow tube has an adjustable length.

10. The modular outflow valve assembly of claim 9, wherein the overflow tube includes an upper overflow tube section slidably coupled to a lower overflow tube section.

11. The modular outflow valve assembly of claim 7, wherein the overflow tube is attached to the lower outflow tube section in place of upper outflow tube section to form single flush-volume configuration.

12. A modular outflow valve assembly for a toilet tank, comprising:

a lower outflow tube section, wherein the lower outflow tube section includes a base configured to be coupled to the toilet tank, a generally upright tube section extending vertically upward from the base, and a side tube section extending horizontally away from the upright tube section, wherein the side tube section terminates in a high-volume flush valve;

an upper outflow tube section, wherein the upper outflow tube section includes a low volume flush valve and an elongate neck section having opposing ends, wherein one end of the elongate neck section is configured to be inserted into the upright tube section on the lower outflow tube section to slidably couple the upper outflow tube section to the lower outflow tube section to form a dual flush-volume configuration, and wherein the other end of the elongate neck section is configured to accept the insertion of an overflow tube, wherein the overflow tube is configured to be insertable into the upright portion of the lower outflow tube section in place of the upper outflow tube section to form a single flush-volume configuration.

13. The modular outflow valve assembly of claim 12, wherein the overflow tube has an adjustable length.

14. The modular outflow valve assembly of claim 13, wherein the overflow tube includes an upper overflow tube section slidably coupled to a lower overflow tube section.

* * * * *